US007155902B2

(12) United States Patent
Nakagome

(10) Patent No.: US 7,155,902 B2
(45) Date of Patent: Jan. 2, 2007

(54) STRUCTURE FOR FIXING CATALYTIC BODY TO EXHAUST PIPE

(75) Inventor: Hiroshi Nakagome, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 289 days.

(21) Appl. No.: 10/806,110

(22) Filed: Mar. 23, 2004

(65) Prior Publication Data

US 2004/0216452 A1 Nov. 4, 2004

(30) Foreign Application Priority Data

Mar. 31, 2003 (JP) ..... 2003-095111
Jun. 27, 2003 (JP) ..... 2003-185011

(51) Int. Cl.
*F01N 3/10* (2006.01)

(52) U.S. Cl. ..... 60/299; 60/272; 60/302; 60/322; 422/169; 422/171; 422/177; 138/114; 138/143

(58) Field of Classification Search ..... 60/272, 60/299, 302, 305, 313, 322; 422/169, 171, 422/177; 138/109, 114, 137, 142, 159
See application file for complete search history.

(56) References Cited

U.S. PATENT DOCUMENTS 5,201,965 A * 4/1993 Ohtsuka et al. ..... 148/333
6,298,935 B1 * 10/2001 Steenackers et al. ..... 180/89.2
6,415,603 B1 * 7/2002 Nowka et al. ..... 60/322
6,729,354 B1 * 5/2004 Ishizu et al. ..... 138/109
6,884,398 B1 * 4/2005 Biel et al. ..... 422/179
6,923,942 B1 * 8/2005 Shirk et al. ..... 422/179

FOREIGN PATENT DOCUMENTS

| | | |
|---|---|---|
| DE | 199 18 301 C1 | 10/2000 |
| JP | 50-92855 | 12/1973 |
| WO | WO 96/27735 A1 | 9/1996 |

* cited by examiner

*Primary Examiner*—Binh Q. Tran
(74) *Attorney, Agent, or Firm*—Birch, Stewart, Kolasch, and Birch, LLP

(57) ABSTRACT

For fixing a catalytic body, which has a cylindrical case and is housed in an exhaust pipe, to the exhaust pipe that serves as part of an exhaust system connected to an engine. The catalytic body can be housed in and fixed to the exhaust pipe even if the catalytic body and the exhaust pipe are made of different materials, thus increasing the freedom in choosing materials for the case of the catalytic body and the exhaust pipe. A bracket, which is made of the same material as an exhaust pipe, is welded to an inner circumferential surface of the exhaust pipe. The bracket is crimped on the case of the catalytic body.

18 Claims, 21 Drawing Sheets

STRUCTURE FOR FIXING CATALYTIC BODY TO EXHAUST PIPE

CROSS-REFERENCE TO RELATED APPLICATIONS

This nonprovisional application claims priority under 35 U.S.C. § 119(a) on Patent Application Nos. 2003-095111 and 2003-185011, filed in Japan on Mar. 31, 2003 and Jun. 27, 2003, respectively. The entirety of each of the above documents is incorporated herein by reference.

BACKGROUND OF THE INVENTION

1. Field of the Invention

The present invention relates to an improvement in a catalytic body fixing structure for fixing a catalytic body to an exhaust pipe serving as part of an exhaust system joined to an engine, the catalytic body having a cylindrical case made of a material different from the exhaust pipe.

2. Description of Background Art

Heretofore, a structure where a catalytic body is housed in and fixed to an exhaust pipe has already been known from Japanese Patent Laid-open No. Sho 50-92855, for example. According to the known structure, the exhaust pipe and a case of the catalytic body are made of the same material. The catalytic body is housed in and fixed to the exhaust pipe by welding a bracket that is welded to an inner surface of the exhaust pipe to the case.

If the case of the catalytic body, the exhaust pipe, and the bracket are made of the same material, then the catalytic body can be fixed to the exhaust pipe by welding as is the case with the conventional structure. However, if the case of the catalytic body and the exhaust pipe are made of different materials, it is difficult to provide the above welded fixing structure. Therefore, there has been a limitation in the background art on the freedom in choosing materials for the case of the catalytic body and the exhaust pipe.

SUMMARY OF THE INVENTION

The present invention has been made under the above circumstances. It is an object of the present invention to provide a structure for fixing a catalytic body to an exhaust pipe. The structure is capable of housing a catalytic body in an exhaust pipe and fixing the catalytic body to the exhaust pipe even if the case of the catalytic body and the exhaust pipe are made of different materials, thus increasing the freedom in choosing materials for the case of the catalytic body and the exhaust pipe.

To achieve the above object, according to a first aspect of the present invention, a catalytic body fixing structure is provided for fixing a catalytic body to an exhaust pipe serving as part of an exhaust system joined to an engine. The catalytic body has a cylindrical case made of a material different from the exhaust pipe and housed in the exhaust pipe. A bracket made of the same material as the exhaust pipe is welded to an inner circumferential surface of the exhaust pipe, the bracket being crimped on the case of the catalytic body.

According to a second aspect of the present invention, a catalytic body fixing structure is provided for fixing a catalytic body to an exhaust pipe serving as part of an exhaust system joined to an engine. The catalytic body has a cylindrical case made of a material different from the exhaust pipe and housed in the exhaust pipe. A bracket made of the same material as the exhaust pipe is welded to an inner circumferential surface of the exhaust pipe, the bracket being coupled to the case of the catalytic body by a rivet.

According to a third aspect of the present invention, a catalytic body fixing structure is provided for fixing a catalytic body to an exhaust pipe serving as part of an exhaust system joined to an engine. The catalytic body has a cylindrical case made of a material different from the exhaust pipe and housed in the exhaust pipe. A bracket made of the same material as the exhaust pipe is welded to an inner circumferential surface of the exhaust pipe, the bracket being fastened to the case of the catalytic body.

With the arrangement of the above aspects of the present invention, even if the case of the catalytic body and the exhaust pipe are made of different materials, the catalytic body can be housed in and fixed to the exhaust pipe, thus increasing the freedom in choosing materials for the case of the catalytic body and the exhaust pipe.

According to a further aspect of the present invention, the catalytic body has a cylindrical catalyst support for allowing an exhaust gas to flow therethrough, the cylindrical catalyst support being housed in the cylindrical case and having an end disposed inwardly of an end of the case, the bracket being crimped on the end of the case in a region projecting from the end of the catalyst support.

According to a further aspect of the present invention, the catalytic body has a cylindrical catalyst support for allowing an exhaust gas to flow therethrough, the cylindrical catalyst support being housed in the cylindrical case and having an end disposed inwardly of an end of the case, the bracket being coupled by the rivet to the end of the case in a region projecting from the end of the catalyst support.

According to a further aspect of the present invention, the catalytic body has a cylindrical catalyst support for allowing an exhaust gas to flow therethrough, the cylindrical catalyst support being housed in the cylindrical case and having an end disposed inwardly of an end of the case, the bracket being fastened to the end of the case in a region projecting from the end of the catalyst support.

With the arrangement of the above further aspects of the present invention, the catalyst body can be fixed to the exhaust pipe by a simple structure without affecting the catalyst support.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Embodiments of the present invention will hereinafter be described with reference to the accompanying drawings.

Figure 1:
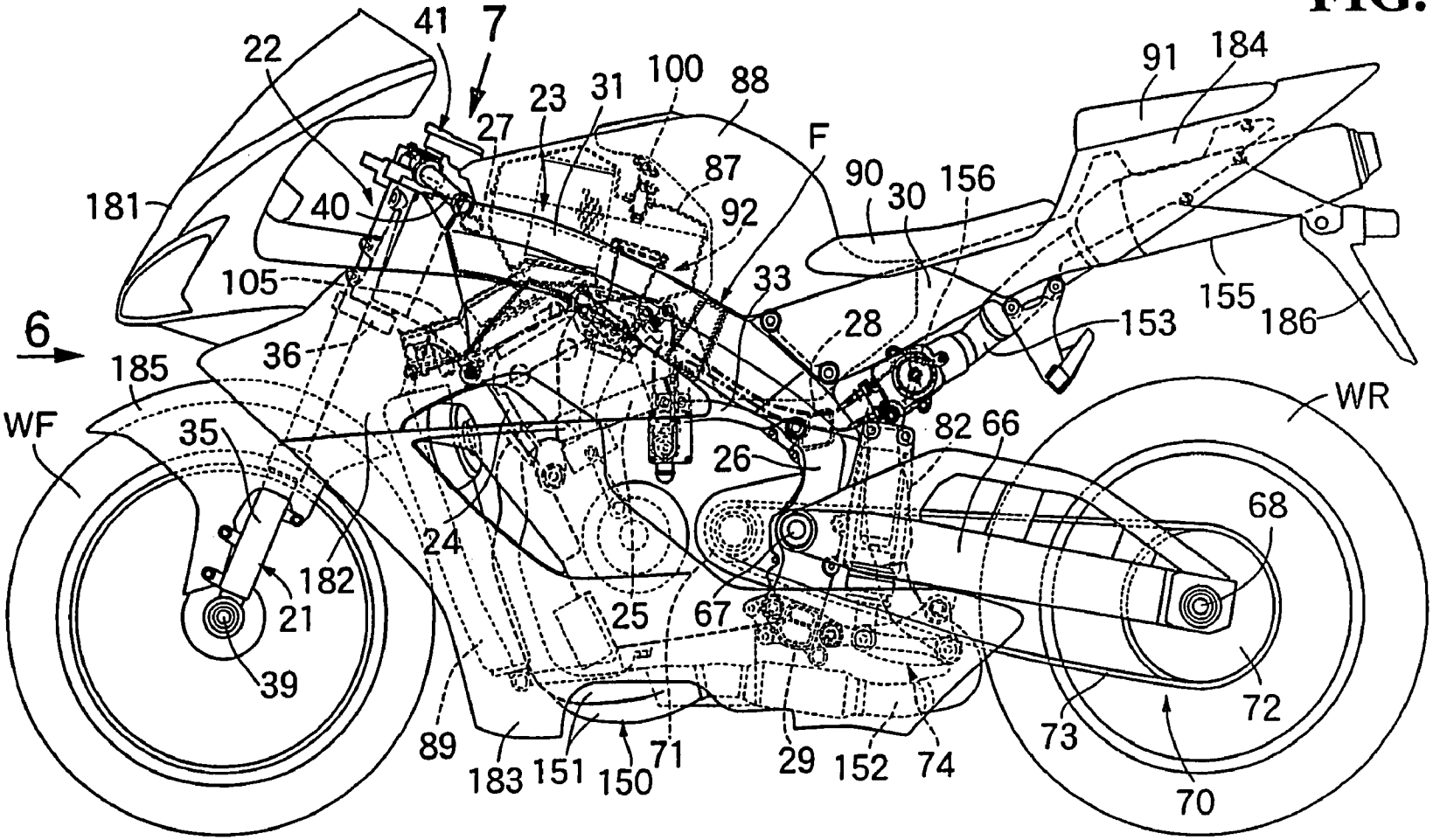
FIG. 1 is a side elevational view of a motorcycle showing a first embodiment.
Figure 2:
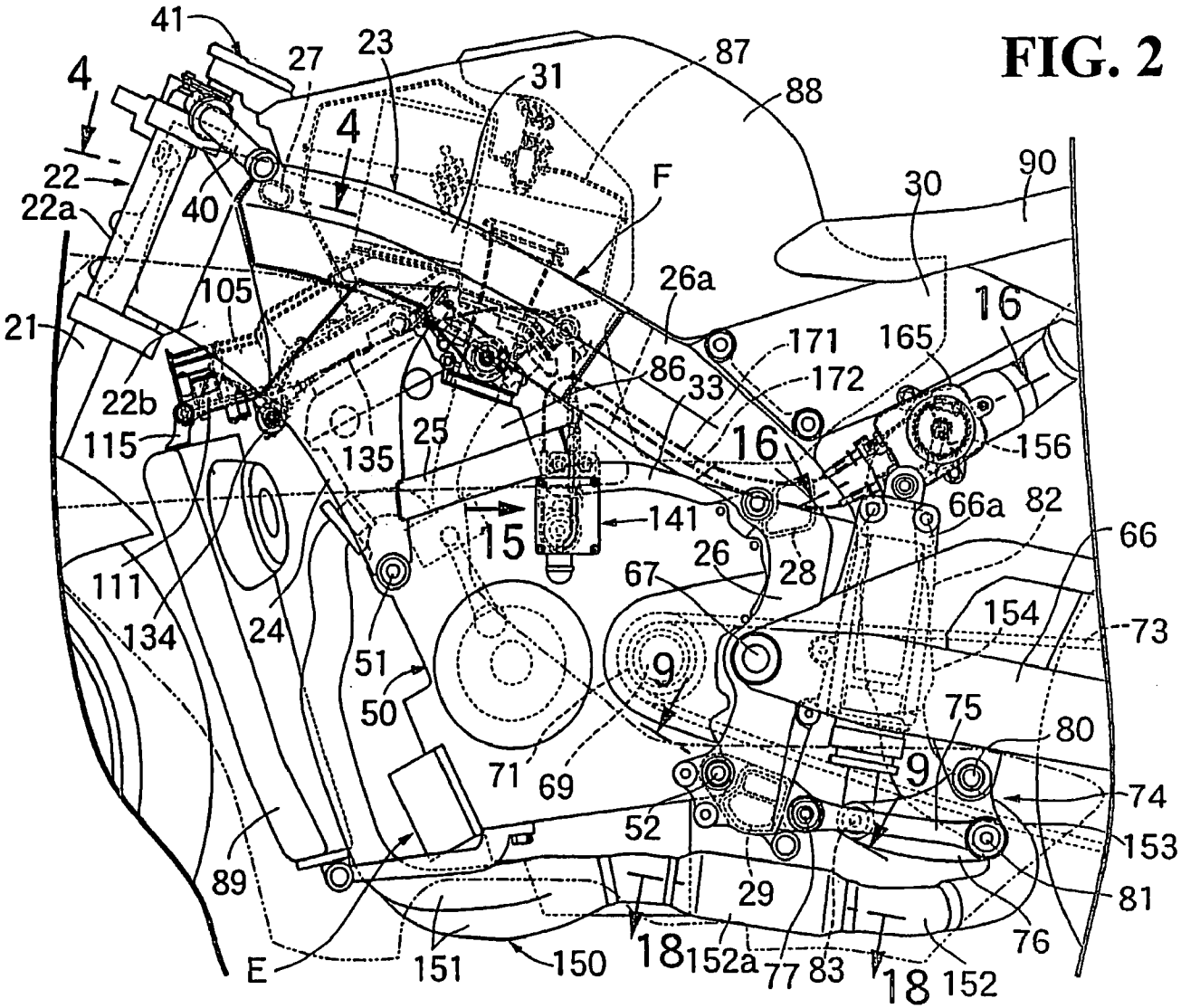
FIG. 2 is an enlarged fragmentary view of FIG. 1.
Figure 3:
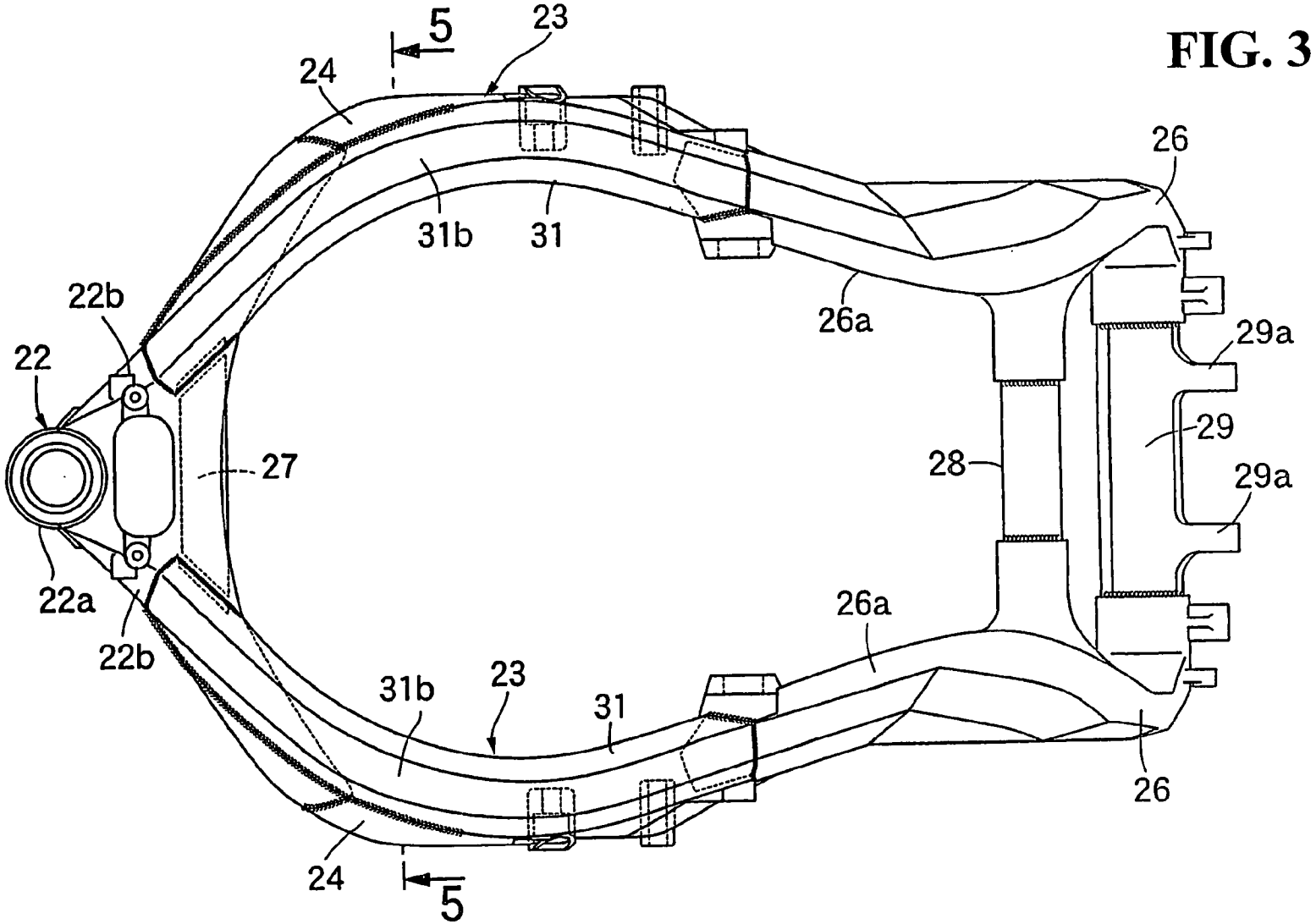
FIG. 3 is a plan view of a front portion of a vehicle frame.

As shown in FIGS. 1 through 3, the motorcycle has a vehicle frame F including a head pipe 22 by which a front fork 21 rotatably supporting a front wheel WF is steerably supported. A pair of left and right main frames 23 extends rearwardly and downwardly from the head pipe 22. A pair of left and right engine hangers 24 is welded to the head pipe 22 and front portions of the main frames 23 and extending downwardly from the main frames 23. Joint pipes 25 join support plates 33 mounted on lower portions of the engine hangers 24 and rear portions of the main frames 23. A pair of left and right pivot plates 26 extends downwardly from the rear portions of the main frames 23. A first cross pipe 27 is disposed between front portions of the main frames 23. A second cross pipe 28 is disposed between upper portions of the pivot plates 26. A third cross pipe 29 is disposed between lower portions of the pivot plates 26. Furthermore, a pair of left and right seat rails 30 extends rearwardly and upwardly and is joined to rear portions of the main frames 23.

Figure 4:
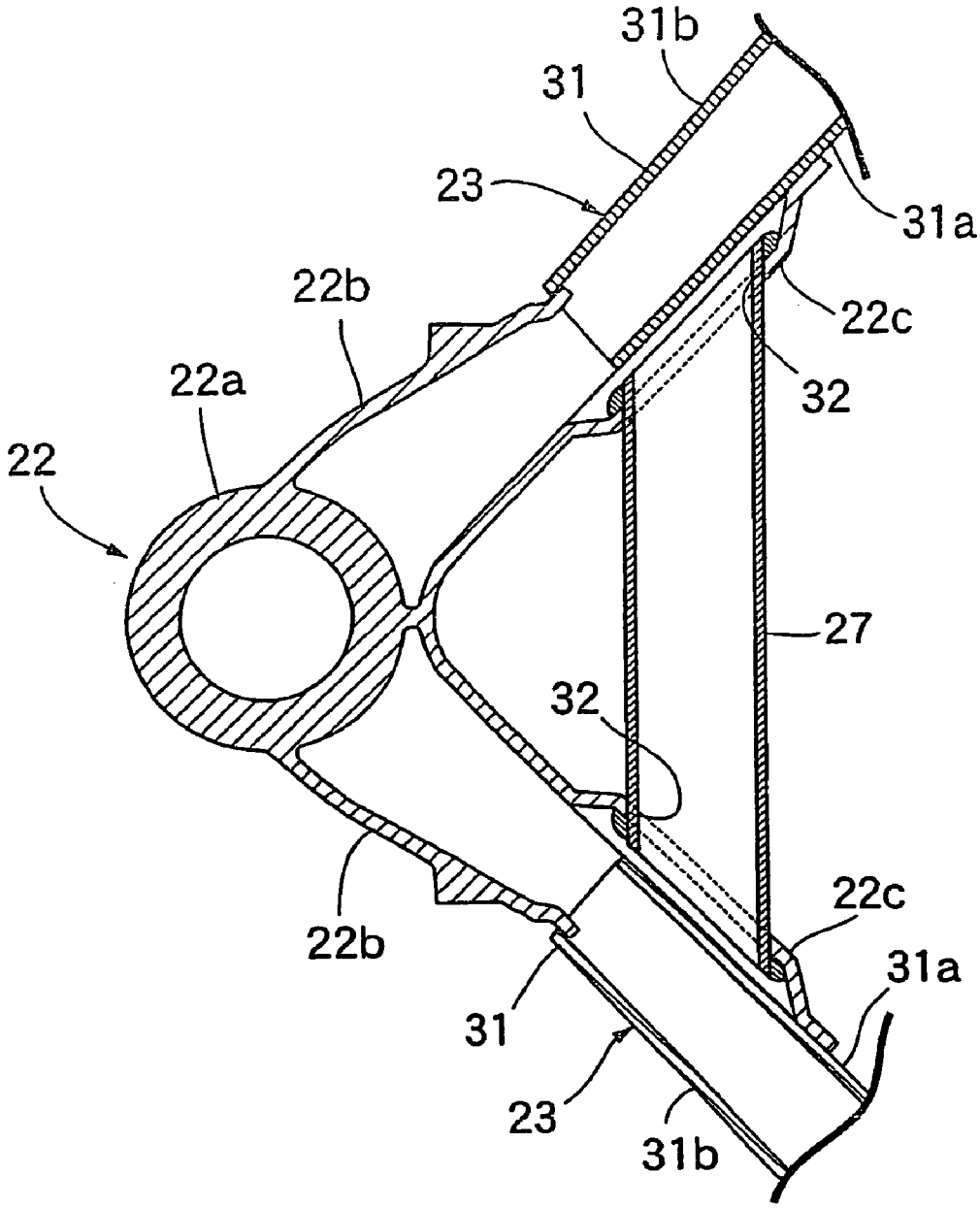
FIG. 4 is an enlarged cross-sectional view of the front portion of the vehicle frame, taken along line 4—4 of FIG. 2.

In FIG. 4, the head pipe 22 has, integrally therewith, a cylindrical portion 22*a* by which the front fork 21 is steerably supported and a pair of left and right gussets 22*b* extending rearwardly and downwardly from the cylindrical portion 22*a*. The main frames 23 include the gussets 22*b*, pipes 31 having front ends welded to the gussets 22*b*, and pipes 26*a* integral with the pivot plates 26 and welded to rear ends of the pipes 31.

In order to install the first cross pipe 27 between the front portions of the main frames 23, attachment holes 32 are coaxially provided in inner side walls of the main frames 23. The first cross pipe 27 has its opposite ends inserted in the respective attachment holes 32 and welded to the inner side walls of the main frames 23.

The gussets 22*b* of the head pipe 22 have integral extensions 22*c* disposed inwardly of front inner side walls of the pipes 31 and extending rearwardly. The extensions 22*c* serve as front inner side walls of the main frames 23. The attachment holes 32 are provided in the respective extensions 22*c*. The opposite ends of the first cross pipe 27 are inserted in the respective attachment holes 32 in confronting relation to the front inner side walls of the pipes 31. The opposite ends of the first cross pipe 27 are welded to outer surfaces of the extensions 22*c*.

Figure 5:
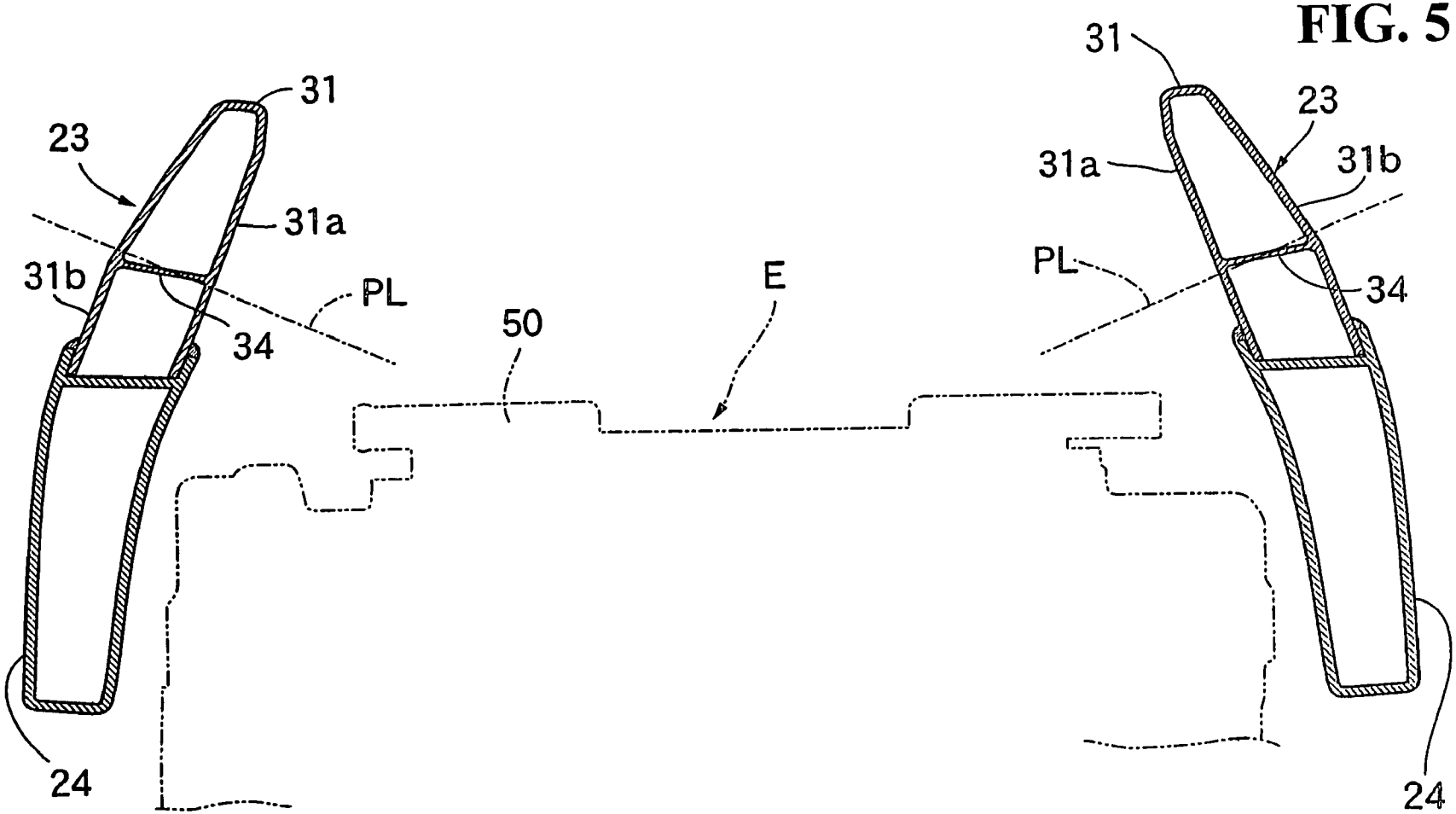
FIG. 5 is a cross-sectional view taken along line 5—5 of FIG. 3.

Referring also to FIG. 5, the pipes 31 are formed from an ingot of aluminum alloy into a transverse outer profile in the shape of a prismatic tube by a conventional known extrusion or drawing process. The pipes 31 have integral ribs 34 extending between vertically intermediate inner surfaces thereof and dividing the interior of the pipes 31 into upper and lower regions. The pipes 31 have lower portions to which the engine hangers 24 are welded and which are open downwardly, i.e., toward the engine hangers 24.

The pipes 31 are in the shape of a vertically elongate prismatic shape having respective inner side walls 31*a*, which are flat substantially the full vertical length thereof, and respective outer side walls 31*b* extending substantially along the inner side walls 31*a*. The pipes 31 are bent in a plane PL perpendicular to the inner side walls 31*a* such that the pipes 31 have respective longitudinally intermediate portions, which are outwardly projected. The bent pipes 31 are inclined progressively toward each other in the upward direction and are joined to the respective gussets 22*b* of the head pipe 22.

Figure 6:
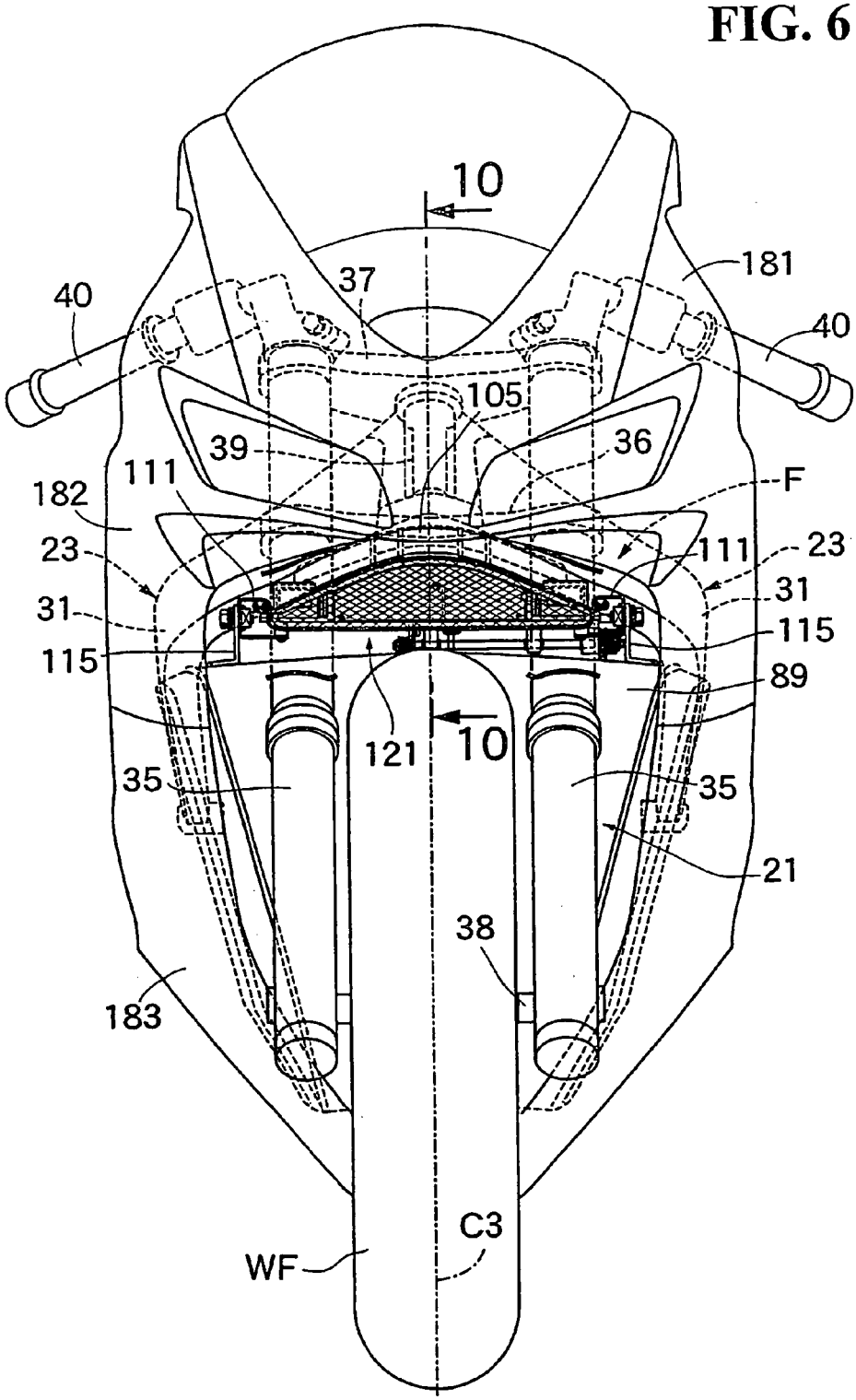
FIG. 6 is an enlarged view as viewed in the direction indicated by the arrow 6 in FIG. 1.

In FIG. 6, the front fork 21 includes cushion units 35 extending vertically on respective left and right sides of the front wheel WF. A bottom bridge 36 interconnects the cushion units 35 above the front wheel WF. Furthermore, a top bridge 37 interconnects upper portions of the cushion units 35. The front wheel WF has an axle 38 supported between the lower ends of the cushion units 35.

Figure 7:
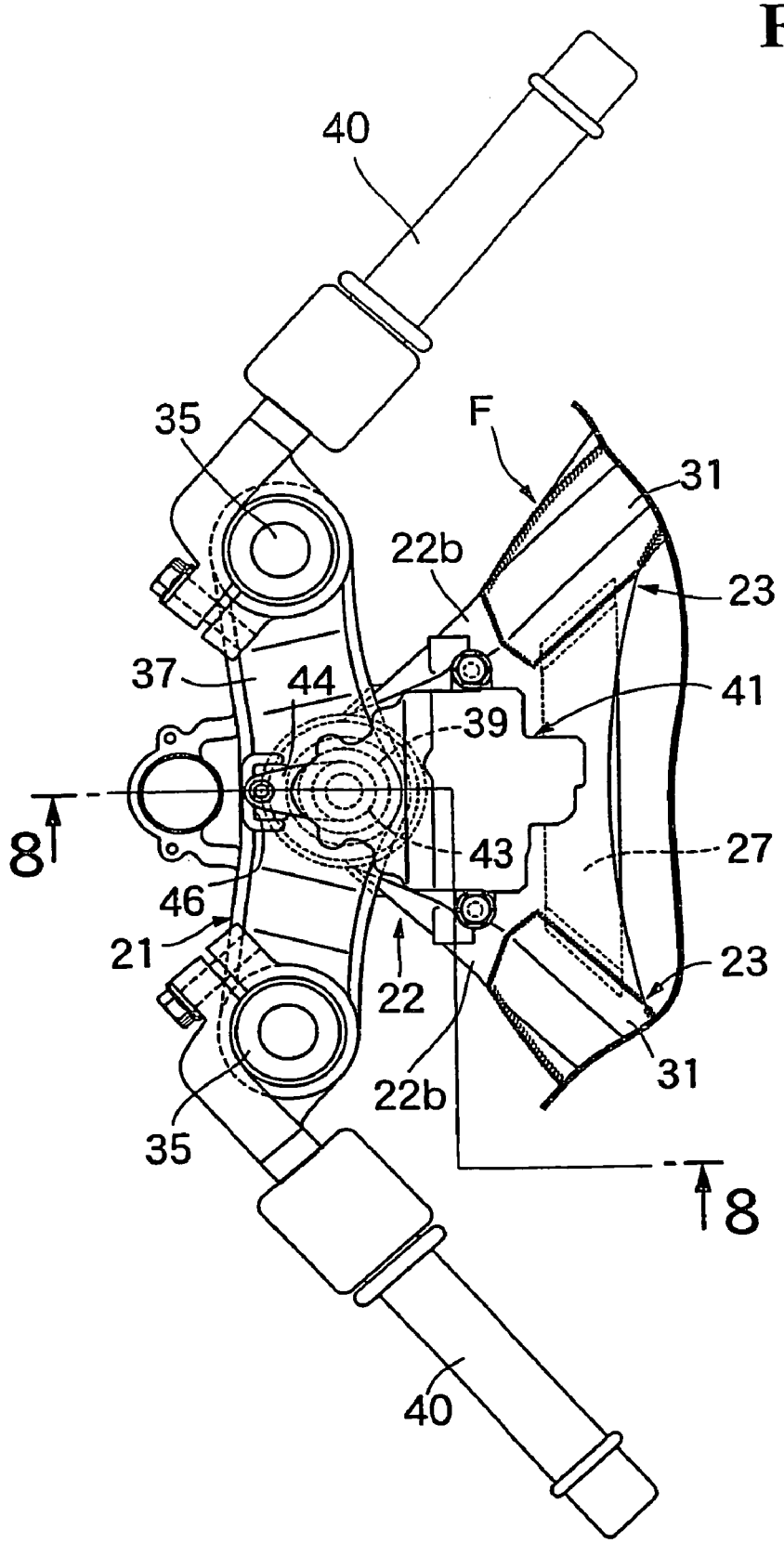
FIG. 7 is an enlarged view as viewed in the direction indicated by the arrow 7 in FIG. 1.
Figure 8:
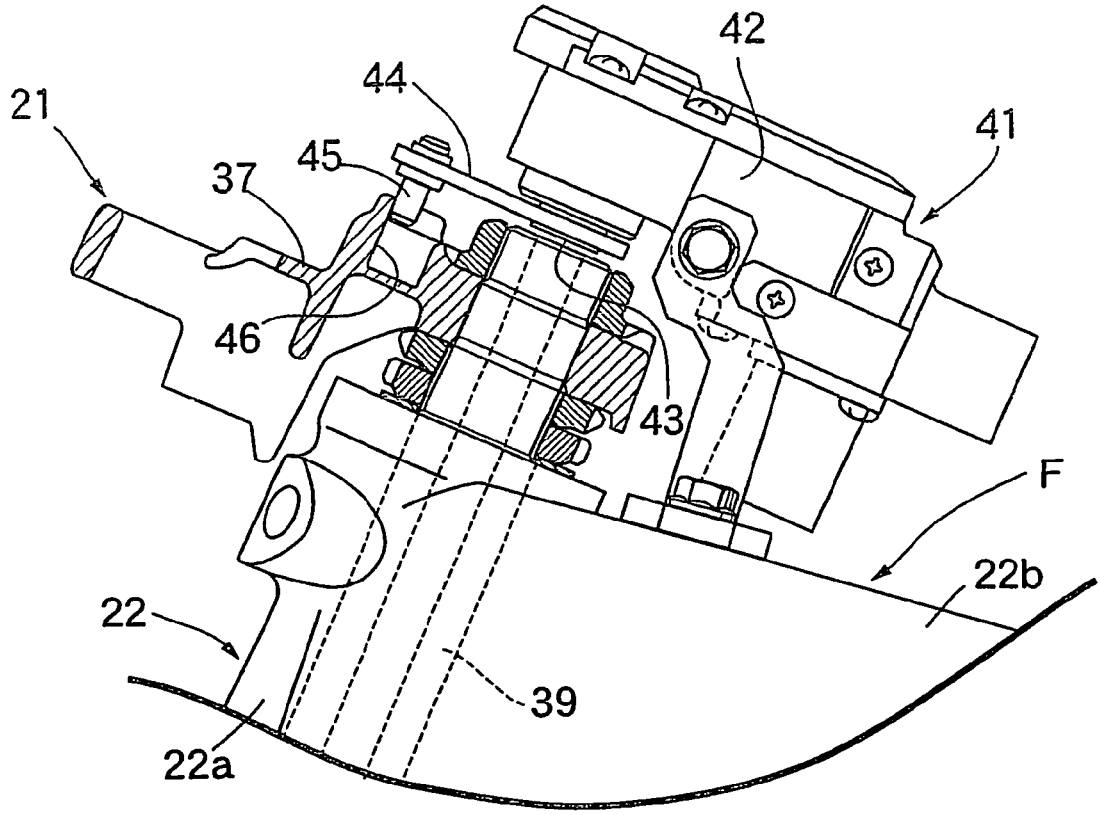
FIG. 8 is a cross-sectional view taken along line 8—8 of FIG. 7.

As also shown in FIGS. 7 and 8, a steering shaft 39, which extends parallel to the cushion units 35, is disposed between the bottom bridge 36 and the top bridge 37 behind a central region between the cushion units 35. The steering shaft 39 is turnably supported by a tubular portion 22*a* of the head pipe 22.

Left and right bar-shaped steering handles 40 are connected to the respective upper ends of the cushion units 35 above the bottom bridge 36. A steering damper 41 is disposed between the front end of the vehicle frame F, i.e., the head pipe 22, and the top bridge 37 of the front fork 21.

The steering damper 41 includes a housing 42 incorporating a hydraulic damping mechanism (not shown) and fixedly supported on the head pipe 22. A turn shaft 43 is disposed above the steering shaft 39 coaxially therewith and turnably supported on the housing 42. An arm 44 has a proximal end fixed to the turn shaft 43 and extends forwardly. A resilient roller 45 is supported rotatably on the distal end of the arm 44. Furthermore, a recess 46 is provided in an upper central surface of the top bridge 37 and is held in fitting frictional contact with the outer circumferential surface of the resilient roller 45.

Rotational vibrations about the steering shaft 39, which are transmitted from the front wheel WF to the top bridge 37, are attenuated by the hydraulic damping mechanism in the housing 42 through the arm 44.

Referring back to FIG. 2, the engine E, which is a multi-cylinder engine having four cylinders, for example, arrayed parallel transversely across the vehicle frame F, has an engine body 50 supported on lower portions of the engine hangers 24 and upper and lower portions of the pivot plates 26.

The engine body 50 is fastened to the lower portions of the engine hangers 24 by a pair of left and right bolts 51.

Figure 9:
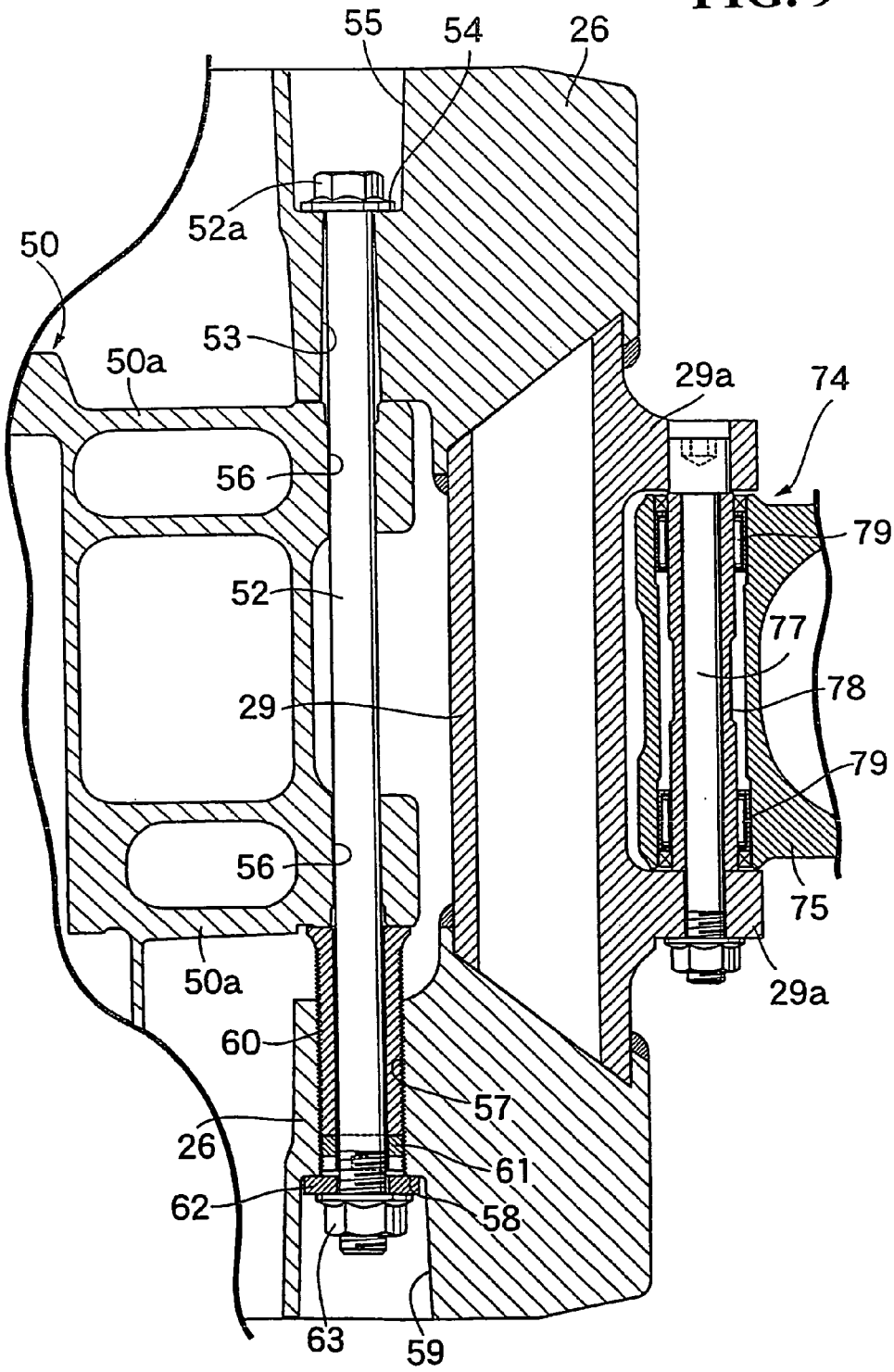
FIG. 9 is a cross-sectional view taken along line 9—9 of FIG. 2.

In FIG. 9, an insertion hole 53 for inserting a mount bolt 52 therethrough and a first engaging surface 54 surrounding the outer end of the insertion hole 53 are provided in a lower portion of one of the pivot plates 26 for supporting the engine body 50 on the lower portions of the pivot plates 26 that are disposed on the opposite sides of the engine body 50 (in the present embodiment, the pivot plate 26 positioned on the right side when viewed forwardly in the direction of travel of the motorcycle). Specifically, the insertion hole 53, which is open at an inner side surface of the pivot plate 26, and a first entry hole 55, which is larger in diameter than the insertion hole 53 and which is open at an outer side surface of the pivot plate 26, are provided in the lower portion of the pivot plate 26. The first engaging surface 54 is formed as an annular step facing the first entry hole 55 between the outer end of the insertion hole 53 and the inner end of the first entry hole 55.

The engine body 50 has a pair of integral support arms 50*a* disposed between the pivot plates 26 and spaced from each other in the axial direction of the mount bolt 52. The support arms 50*a* have respective through holes 56 provided coaxially therein for the insertion of the mount bolt 52 therethrough.

The lower portion of the other pivot plate 26 has a threaded hole 57 coaxial with the insertion hole 53 and a second engaging surface 58 surrounding the outer end of the threaded hole 57. Specifically, the threaded hole 57, which is open at an inner side surface of the pivot plate 26, and a second entry hole 59 which is larger in diameter than the threaded hole 57 and which is open at an outer side surface of the pivot plate 26, are provided in the lower portion of the pivot plate 26. The second engaging surface 58 is formed as an annular step facing the second entry hole 59 between the outer end of the threaded hole 57 and the inner end of the second entry hole 59.

A tubular bolt 60 is threaded in the threaded hole 57 and has an end held in abutment against the engine body 50. Specifically, while one of the support arms 50*a* is being held in abutment against an inner side surface of one of the pivot plates 26, the tubular bolt 60 is threaded in the threaded hole 57 with the end thereof held in abutment against the other support arm 50*a*. A tubular retaining bolt 61 is also threaded in the threaded hole 57 in abutment against the other end of the tubular bolt 60 to prevent the tubular bolt 60 from working loose. The tubular bolt 60 and the retaining bolt 61 are threaded in the threaded hole 57 with the other end of the tubular bolt 60 and the retaining bolt 61 being positioned inwardly of the second engaging surface 58 while the engine body 50 is being sandwiched between the inner side surface of the one of the pivot plates 26 and the end of the tubular bolt 60.

The mount bolt 52 is inserted through the insertion hole 53, the through holes 56 in the engine body 50, the tubular bolt 60, the retaining bolt 61, and the threaded hole 57. The mount bolt 52 has a larger-diameter head 52*a* on an end thereof, which engages with one of the first and second engaging surfaces 54, 58, and a nut 63 engaging the other of the first and second engaging surfaces 54, 58 is threaded over the other end of the mount bolt 52. In the present embodiment, the other end of the mount bolt 52 whose larger-diameter head 52*a* engages with the first engaging surface 54 projects from the threaded hole 57, and the nut 63, which is threaded over the other end of the mount bolt 52 that projects from the threaded hole 57, engages with the second engaging surface 58 with a washer 62 interposed therebetween.

A structure by which the engine body 50 is supported on the upper portions of the pivot plates 26 is basically the same as the structure by which the engine body 50 is supported on the lower portions of the pivot plates 26, and will not be described in detail below.

A swing arm 66 has a front end swingably supported by a support shaft 67 on vertically intermediate portions of the pivot plates 26. A rear wheel WR has an axle 68 rotatably supported on the rear end of the swing arm 66.

The engine body 50 incorporates therein a transmission whose output shaft 69 transmits power through a chain transmitting means 70 to the rear wheel WR. The chain transmitting means 70 includes a drive sprocket 71 fixed to the output shaft 69, a driven sprocket 72 fixed to the rear wheel WR, and an endless chain 73 trained around the sprockets 71, 72. The chain transmitting means 70 is disposed on the left side of the engine E when viewed forwardly in the direction of travel of the motorcycle.

A link mechanism 74 is disposed between the third cross pipe 29 interconnecting the lower portions of the pivot plates 26 and the swing arm 66. The link mechanism 74 includes a first link 75 having an end joined to the third cross pipe 29 so as to be rotatable about a first joint shaft 77 parallel to the support shaft 67, and a second link 76 joined to a lower portion of the swing arm 66 so as to be rotatable about a second joint shaft 80 parallel to the first joint shaft 77 and joined to the other end of the first link 75 by a third joint shaft 81 parallel to the first and second joint shafts 77, 80.

The third cross pipe 29 has a pair of integral shaft supports 29*a* projecting rearwardly from two locations that are longitudinally spaced from each other thereon. A collar 78 is mounted on the first joint shaft 77 that is disposed between the shaft supports 29*a*, and the first link 75 has an end supported on the collar 78 by a pair of roller bearings 79.

The other end of the first link 75 is joined to a rear portion of the second link 76 by the third joint shaft 81. A rear cushion unit 82 has an upper end coupled to a bracket 66*a* mounted on a front portion of the swing arm 66 and a lower end coupled to a front portion of the second link 76 by a fourth joint shaft 83.

Figure 10:
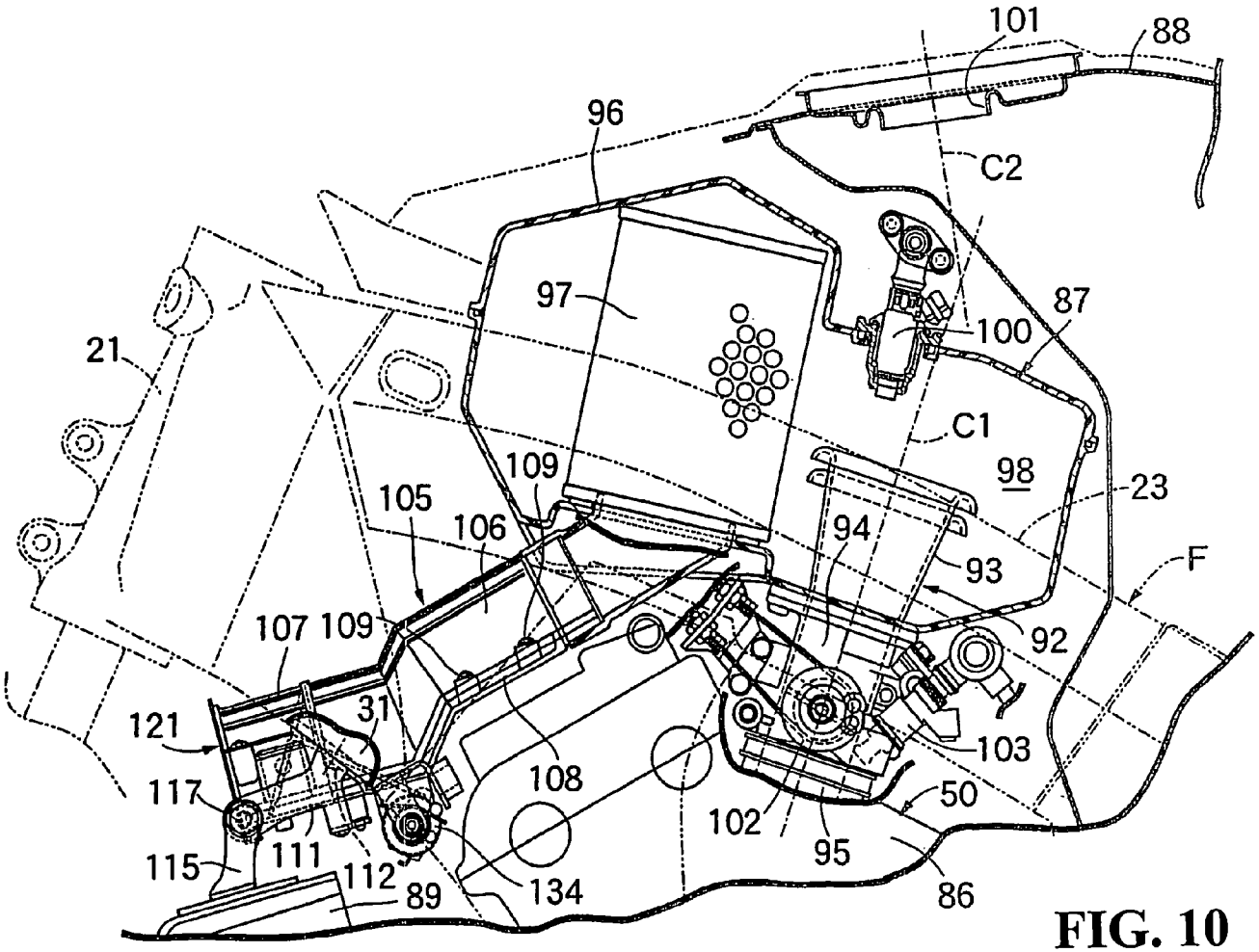
FIG. 10 is a cross-sectional view taken along line 10—10 of FIG. 6.
Figure 11:
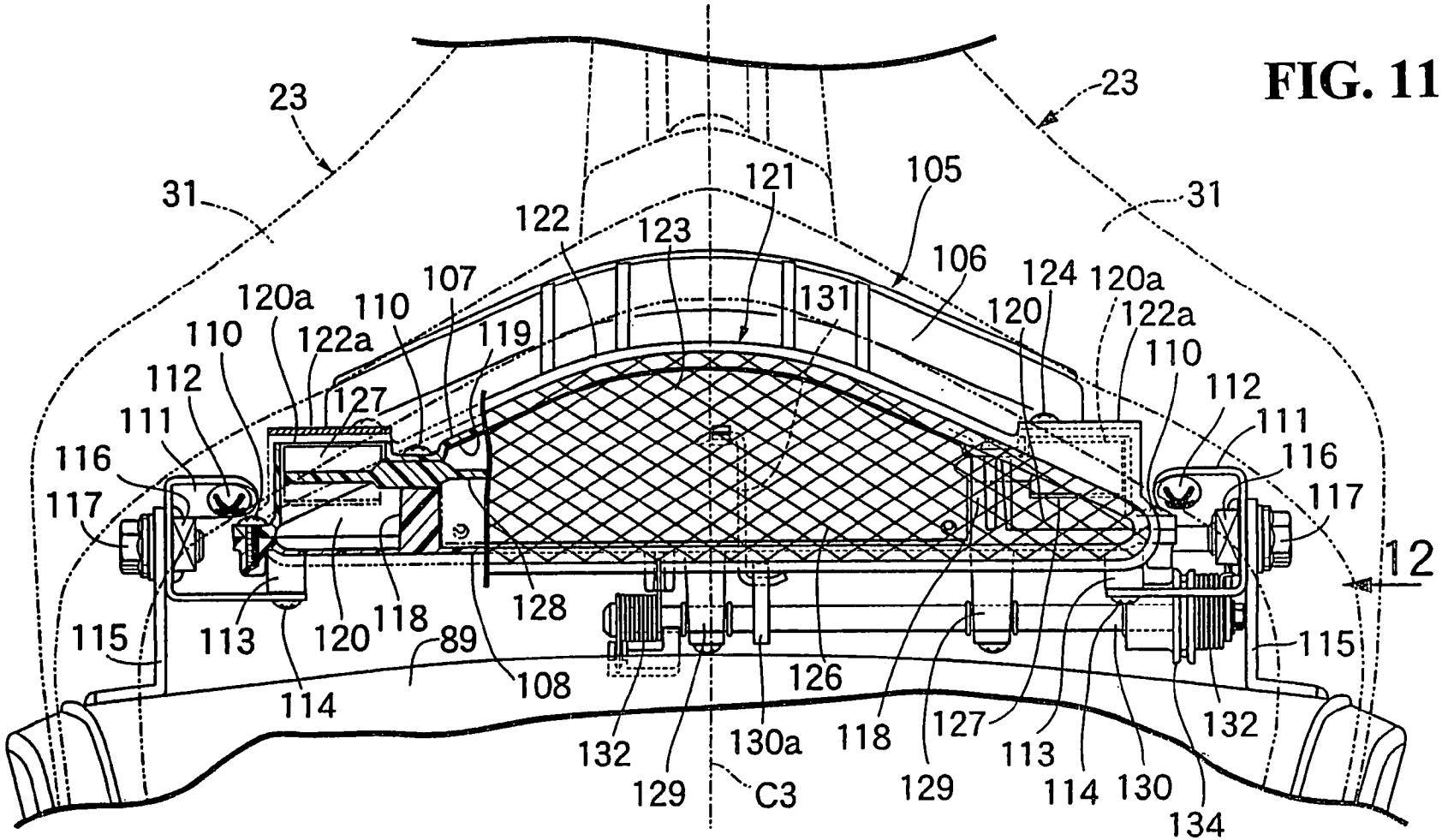
FIG. 11 is an enlarged fragmentary view of FIG. 6.
Figure 12:
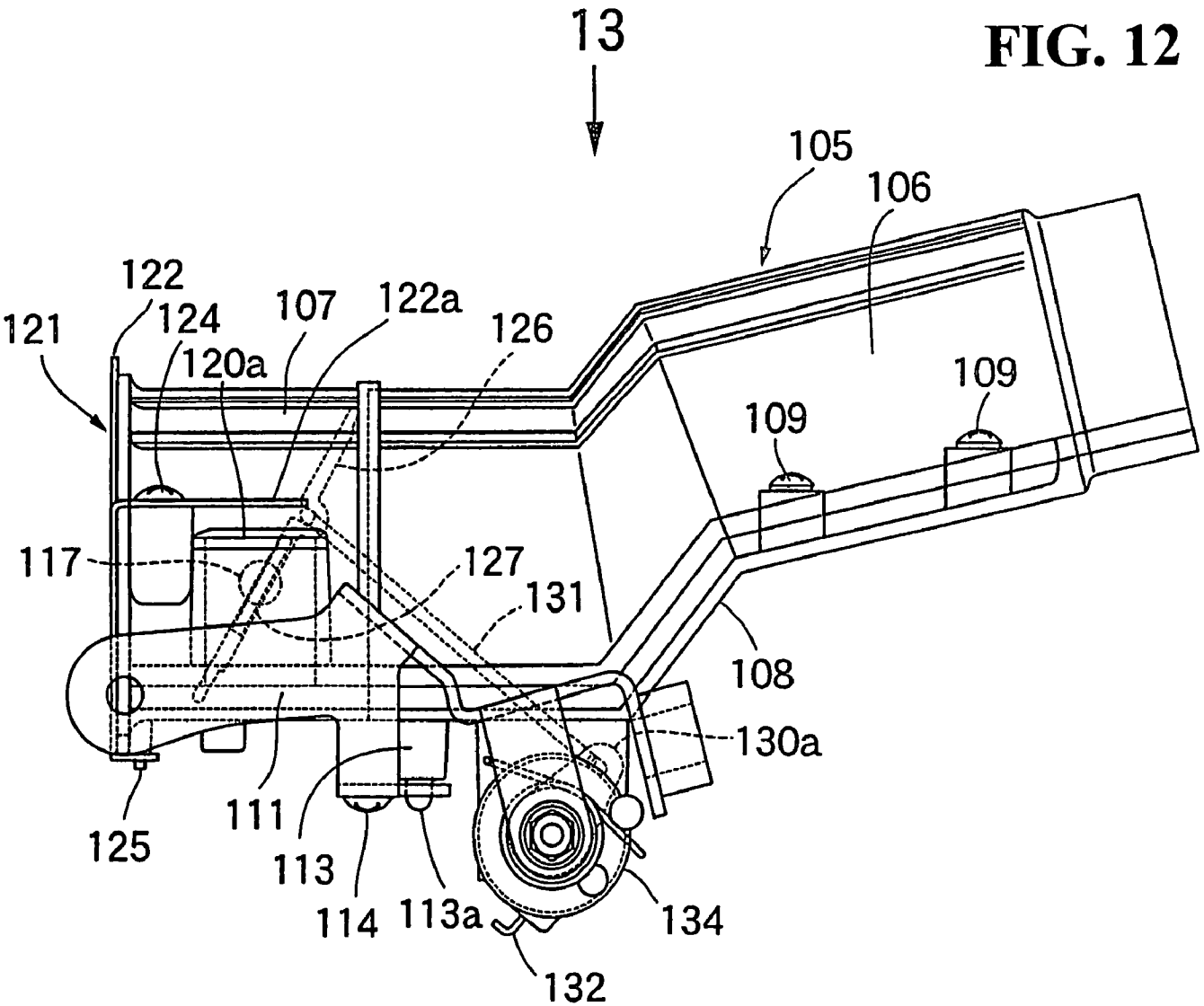
FIG. 12 is a view as viewed in the direction indicated by the arrow 12 in FIG. 11.
Figure 13:
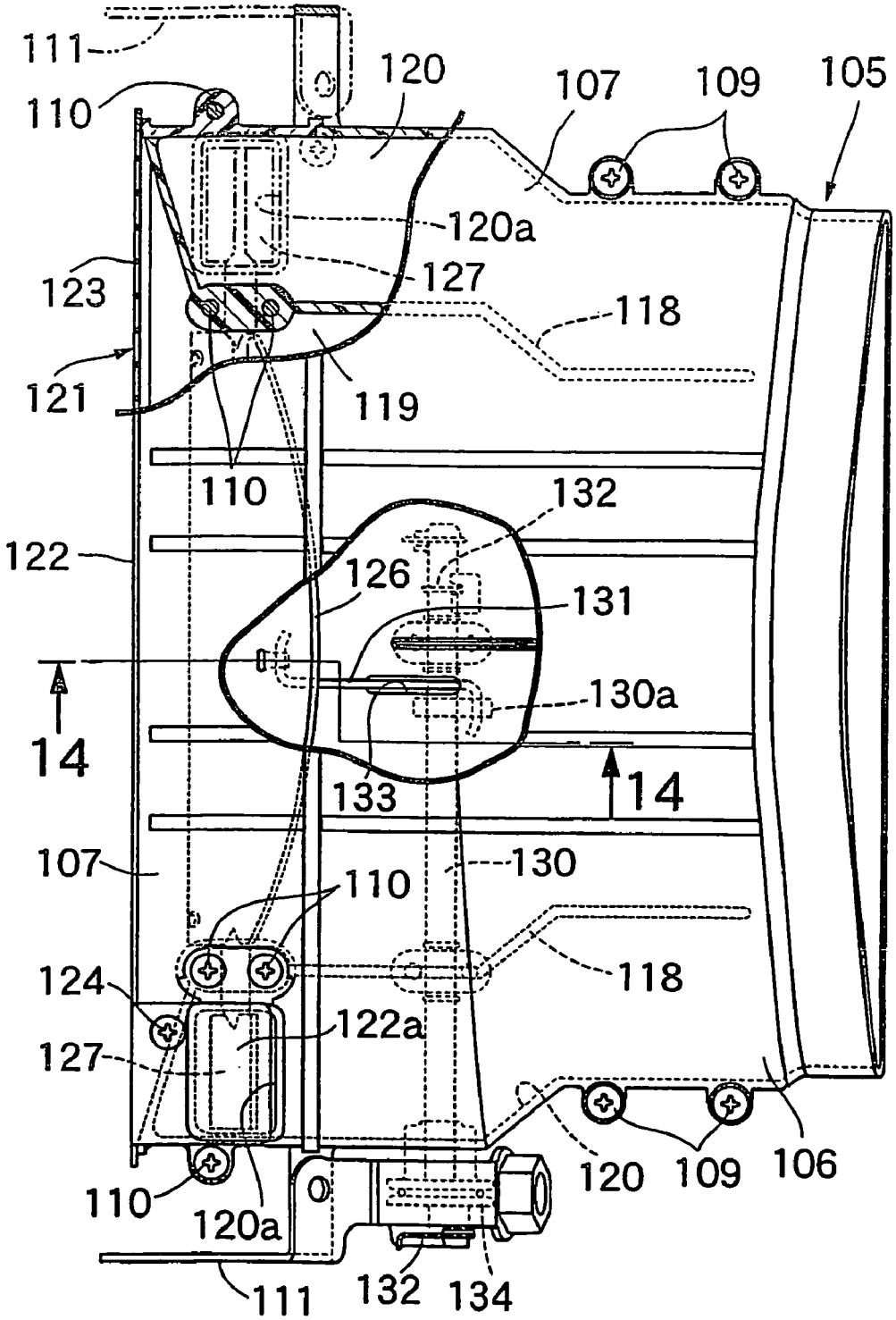
FIG. 13 is a transverse plan view, partly cut away, as viewed in the direction indicated by the arrow 13 in FIG. 12.

Referring also to FIG. 10, an air cleaner 87 for purifying air to be supplied to the engine E is disposed above a cylinder head 86 of the engine body 50 behind the head pipe 21 of the vehicle frame F. The air cleaner 87 has rear and upper portions covered with a fuel tank 88, which is mounted on the main frames 23 of the vehicle frame F. A radiator 89 is disposed forwardly of the engine body 50. As shown in FIG. 2, a main seat 90 for the rider to ride on is supported on the seat rails 30 behind the fuel tank 88. A pillion seat 91 for a passenger to ride on is supported on the seat rails 30 at a position spaced rearwardly from the main seat 90.

Straight intake passages 92 for guiding purified air from the air cleaner 87 above the cylinder head 86 are connected to an upper side wall of the cylinder head 86 in communication with the respective cylinders. The intake passages 92 include respective funnels 93 having upper open ends projecting into the air cleaner 87, and respective throttle bodies 94 connected to the respective lower ends of the funnels 93.

The throttle bodies 94 are connected to the upper side wall of the cylinder head 86 with an insulator 95 interposed therebetween.

The air cleaner 87 includes a cylindrical cleaner element 97 fixedly housed in a cleaner case 96, with a purification chamber 98 provided around the cleaner element 97 in the cleaner case 96 for being supplied with air that has been purified by passing through the cleaner element 97. The funnels 93 on the upper ends of the intake passages 92 are installed parallel to each other on the cleaner case 96 so as to be open into the purification chamber 98.

First injectors 100 for injecting fuel when the engine E rotates at a high speed are mounted on the cleaner case 96 of the air cleaner 87 for the respective cylinders of the engine E. The first injectors 100 are disposed forwardly of central lines C1 of the intake passages 92, and are mounted on the cleaner case 96 so as to have their axes inclined to the central lines C1. A fuel pump (not shown) is disposed in the fuel tank 88 for supplying fuel to the first injectors 100.

The fuel tank 88 has a fuel inlet port 101 provided in a front portion thereof The first injectors 100 are disposed forwardly of a central line C2 of the fuel inlet port 101. The first injectors 100 are mounted on the cleaner case 96 such that their upper portions are disposed forwardly of points P of intersection between the central lines C1, C2 on a projection onto a plane parallel to the central line C2 of the fuel inlet port 101 and the central lines C1 of the intake passages 92.

The throttle bodies 94 in the intake passages 92 house respective throttle valves (not shown) for controlling the amount of intake air flowing through the intake passages 92. A throttle drum 102 coupled to the throttle valves is disposed laterally of the throttle bodies 94.

Second injectors 103 for ejecting fuel supplied from the fuel pump in the fuel tank 88 depending on the operating state of the engine E are disposed closer to the engine E than the throttle valves rearwardly and laterally of the throttle bodies 94.

Referring also to FIGS. 11 through 14, an intake duct 105 for introducing external air into the air cleaner 87 is disposed below the head pipe 21 at the front end of the vehicle frame F and extends forwardly from the air cleaner 87. The intake duct 105 has a rear end projecting into and fixed to a lower portion of the cleaner case 96 for introducing external air into the cleaner element 97 in the air cleaner 87.

The intake duct 105 includes a rear main duct body 106 having a substantially triangular transverse cross-sectional shape including a transversely central portion raised upwardly and a lower open portion, a front main duct body 107 having substantially the same transverse cross-sectional shape as the rear main duct body 106 and joined to a front portion of the rear main duct body 106, and a lower lid plate 108 closing the lower open ends of the rear and front main duct bodies 106, 107. The intake duct 105 has a rear portion inclined upwardly in the rearward direction as viewed in side elevation. The lower lid plate 108 is fastened to the rear main duct body 106 by a plurality of screws 109 and also fastened to the front main duct body 107 by a plurality of screws 110.

Support stays 111 are fixed by screws 112 to front lower surfaces of the pipes 31, which serve as part of the main frames 23 of the vehicle frame F. Attachment bosses 113 disposed on lower portions of opposite front sides of the intake duct 105 are fastened to the support stays 111 by screws 114, thus supporting the front portion of the intake duct 105 on the vehicle frame F. Positioning pins 113*a* inserted in the support stays 111 project on the attachment bosses 113.

The radiator 89 is disposed below the intake duct 105. Stays 115 extend upwardly from opposite sides of the radiator 89. Welded nuts 116 are fixed to the support stays 111, and bolts 117 inserted through the stays 115 and the support stays 111 are threaded through the welded nuts 116, thus supporting the radiator 89 on the vehicle frame F.

The lower lid plate 108 of the intake duct 105 has a pair of integral partition walls 118 held in abutment against lower surfaces of upper portions of the rear and front main duct bodies 106, 107. In the intake duct 105, there are provided a first intake passage 119 whose transversely central portion is disposed on a transversely central line C3 of the front wheel WF and a pair of left and right second intake passages 120 disposed one on each side of the first intake passage 119, by the partition walls 118 between the first intake passage 119 and the second intake passages 120. The first intake passage 119 has a flow passage area greater than the total flow passage area of the second intake passages 120.

The partition walls 118 have front portions inclined so as to be progressively spaced away from each other in the forward direction. The partition walls 118 have front ends held in abutment against inner surfaces of the opposite side walls of the front main duct body 107. The first intake passage 119 has a front portion, which is open forwardly at the front end of the intake duct 105, so as to occupy an entire end opening of the intake duct 105. The second intake passages 120 have respective front end openings 120*a* provided in the front end of the intake duct 105 so as to be open in a direction different from the direction in which the front end of the first intake passage 119 is open. In the present embodiment, the front end openings 120*a* are provided in the front main duct body 107 so as to be open upwardly on both left and right sides of the front end of the first intake passage 119.

The front end of the intake duct 105 is of a substantially triangular shape as viewed from its front side. The front end of the intake duct 105 has an upper edge extending along the lower edge of a junction between the head pipe 21 and the main frames 23 and a lower edge extending along the upper portion of the radiator 89. A grill 121 is mounted on the front end of the intake duct 105.

The grill 121 includes a frame member 122 complementary in shape to the front end opening edge of the intake duct 105 and a mesh member 123 having a peripheral edge supported on the frame member 122. Baffle plates 122*a* are integrally formed with the frame member 122 at respective positions spaced from the front end openings 120*a* of the second intake passages 120. The baffle plates 122*a* are fastened to front opposite sides of the front main duct body 107 of the intake duct 105 by screws 124. Positioning pins 125 for preventing a lower portion of the frame member 122 from being dislodged from the front end of the intake duct 105 project from the front end of the lower lid plate 108 and are inserted into the lower portion of the frame member 122.

In the first intake passage 119, there is disposed a first butterfly intake control valve 126, which is controlled depending on the rotational speed of the engine E, for closing the first intake passage 119 when the engine E operates in a low rotational speed range and opening the first intake passage 119 when the engine E operates in a high rotational speed range. In the second intake passages 120, there are disposed second butterfly intake control valves 127, which are controlled depending on the rotational speed of the engine E, for opening the second intake passages 120 when the engine E operates in a low rotational speed range and closing the second intake passages 120 when the engine E operates in a high rotational speed range. The first butterfly intake control valve 126 and the second butterfly intake control valves 127 are fixed in common to a valve shaft 128. The shaft 128 has an axis perpendicular to the direction in which air flows through the first intake passage 119 and is turnably supported in the intake duct 105.

The valve shaft 128 is rotatably supported on the partition walls 118 in regions of the intake duct 105, which correspond to the front end openings 120*a* of the second intake passages 120. Of the screws 110 that fasten the front main duct body 107 to the lower lid plate 108, two pairs of screws 110 are threaded into the partition walls 118 at positions one on each side of the valve shaft 128.

Figure 14:
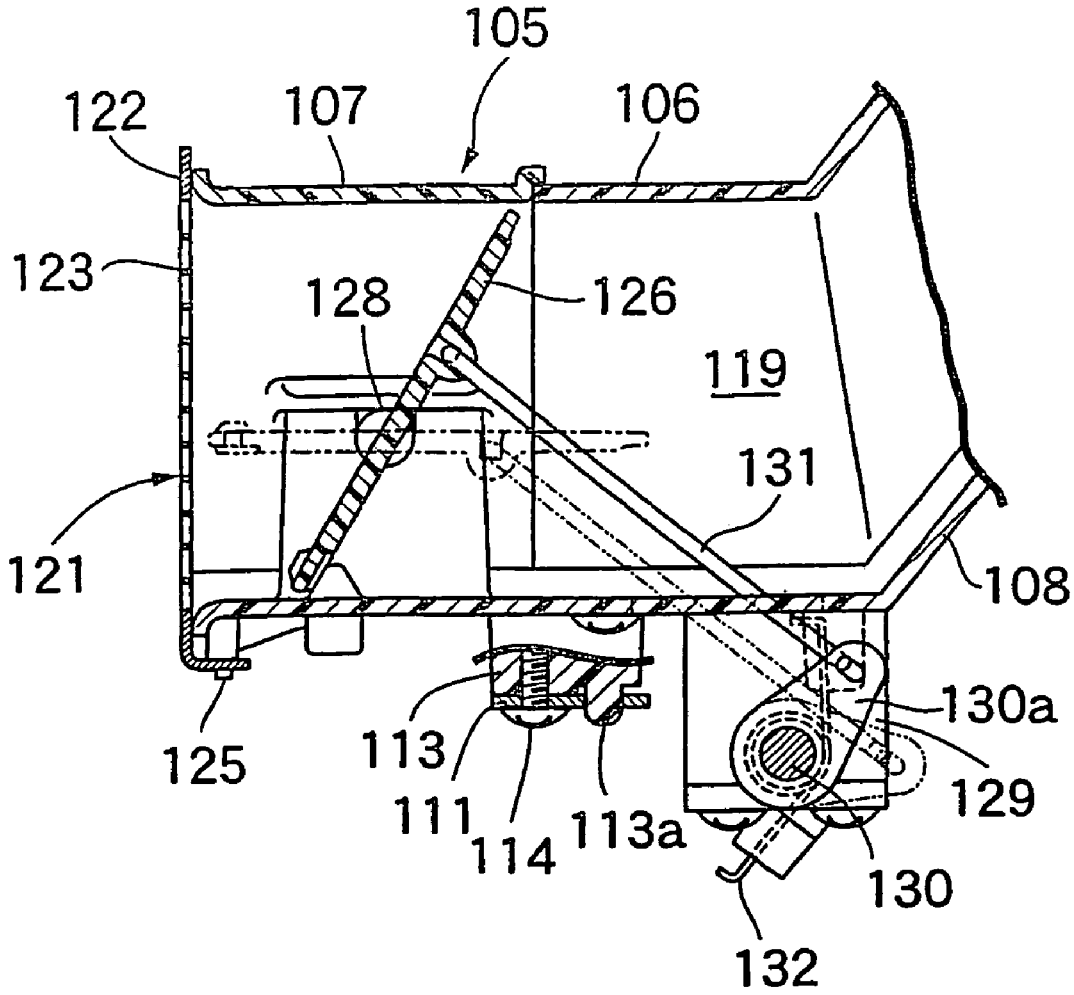
FIG. 14 is a cross-sectional view taken along line 14—14 of FIG. 13;.

The first intake control valve 126, which changes the flow passage area of the first intake passage 119, is fixed to the valve shaft 128 such that it is inclined upwardly in the rearward direction when it closes the first intake passage 119, as shown in FIG. 14. The first intake control valve 126 has a portion above the valve shaft 128, which has an area greater than the area of a portion of the first intake control valve 126 beneath the valve shaft 128. When the first intake control valve 126 opens the first intake passage 119, it lies substantially horizontally as indicated by the two-dot-and-dash lines in FIG. 14 to impose a minimum resistance on air flowing through the first intake passage 119.

The second intake control valves 127, which change the flow passage areas of the second intake passages 120, are fixed to the valve shaft 128 such that they open the front end openings 120*a* of the second intake passages 120 when the first intake control valve 126 closes the first intake passage 119.

A turn shaft 130 parallel to the valve shaft 128 is disposed rearwardly of the valve shaft 128 and below the intake duct 105. The turn shaft 130 is turnably supported by a plurality of bearings 129 projecting from a lower surface of the intake duct 105, i.e., a lower surface of the lower lid plate 108.

An arm 130*a* is mounted on a portion of the turn shaft 130 corresponding to the first intake passage 119. A joint rod 131 which extends through the lower portion of the intake duct 105, i.e., the lower lid plate 108, has an end connected to a portion of the first intake control valve 126 as it is closed above the valve shaft 128 and an opposite end connected to the arm 130*a*. When the turn shaft 130 is turned about its own axis, the first intake control valve 126 is turned between the closing side indicated by the solid lines in FIG. 14 and the opening side indicated by the two-dot-and-dash lines in FIG. 14.

Return springs 132 for exerting spring forces to bias the turn shaft 130 and the valve shaft 128 in a direction to bring the first intake control valve 126 into the closing side are disposed between the opposite ends of the turn shaft 130 and the intake duct 105. The joint rod 131 movably extends through a through hole 133 provided in the lower lid plate 108. The through hole 133 is elongate in the fore-and-aft direction to allow the joint rod 131 extending through the lower lid plate 108 to move in the fore-and-aft direction as the arm 130*a* is turned in unison with the turn shaft 130.

A driven pulley 134 is fixed to an end of the turn shaft 130. To the driven pulley 134, there is transmitted rotational power through a first transmission wire 135 from an actuator 141, which is supported on one of the support plates 33 in rear portions of the main frames 23 and disposed on the left side of an upper portion of the engine body 50.

Figure 15:
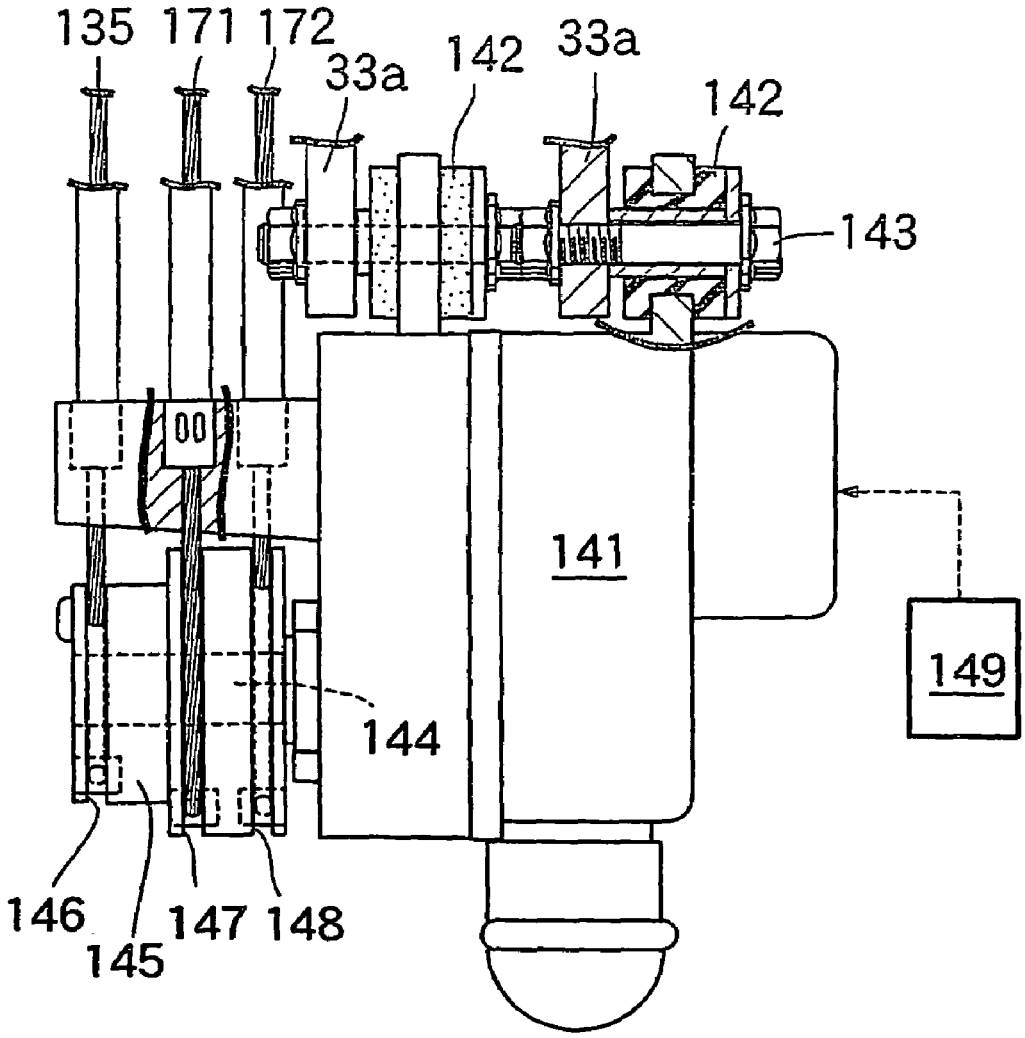
FIG. 15 is an enlarged view as viewed in the direction indicated by the arrow 15 in FIG. 2.

As shown in FIG. 15, the actuator 141 includes a reversible electric motor and a speed-reduction mechanism for reducing the rotational speed of output power from the electric motor. The actuator 141 is mounted on a pair of brackets 33*a* of one of the support plates 33 of the vehicle frame F by a bolt 143 with resilient members 142 interposed therebetween. The actuator 141 has an output shaft 144 on which there is fixedly mounted a drive pulley 145 having a first small-diameter wire groove 146 and second and third large-diameter wire grooves 147, 148.

The first transmission wire 135 for transmitting rotational power to the driven pulley 134 on the intake duct 105 has an end trained around and engaged with the first wire groove 146.

An electronic control unit 149 is connected to the actuator 141, and controls operation of the actuator 141 depending on the rotational speed of the engine, which is input from a sensor (not shown).

Referring back to FIGS. 1 and 2, an exhaust system 150 connected to the engine E includes individual exhaust pipes 151 connected to a lower portion of a front side wall of the cylinder head 86 of the engine body 50, a pair of first joint exhaust pipes 152 to each of which a pair of individual exhaust pipes 151 is connected in common, a single second joint exhaust pipe 153 to which the first joint exhaust pipes 152 are connected in common, with a first exhaust muffler 154 disposed in an intermediate portion thereof, and a second exhaust muffler 155 connected to a downstream end of the second joint exhaust pipe 153.

The individual exhaust pipes 151 extend downwardly from the front of the engine body 50, and the first joint exhaust pipes 152 extend substantially in the fore-and-aft direction below the engine body 50. The second joint exhaust pipe 153 is curved upwardly between the rear wheel WR and the engine body 50 and directed from below the engine body 50 to the right of the vehicle body, and then extends rearwardly above the rear wheel WR. The first exhaust muffler 154 is disposed in the rising portion of the second joint exhaust pipe 153, and a rear end outlet of the exhaust system 150, i.e., a downstream end of the second exhaust muffler 155, is disposed above the axle 68 of the rear wheel WR.

Figure 16:
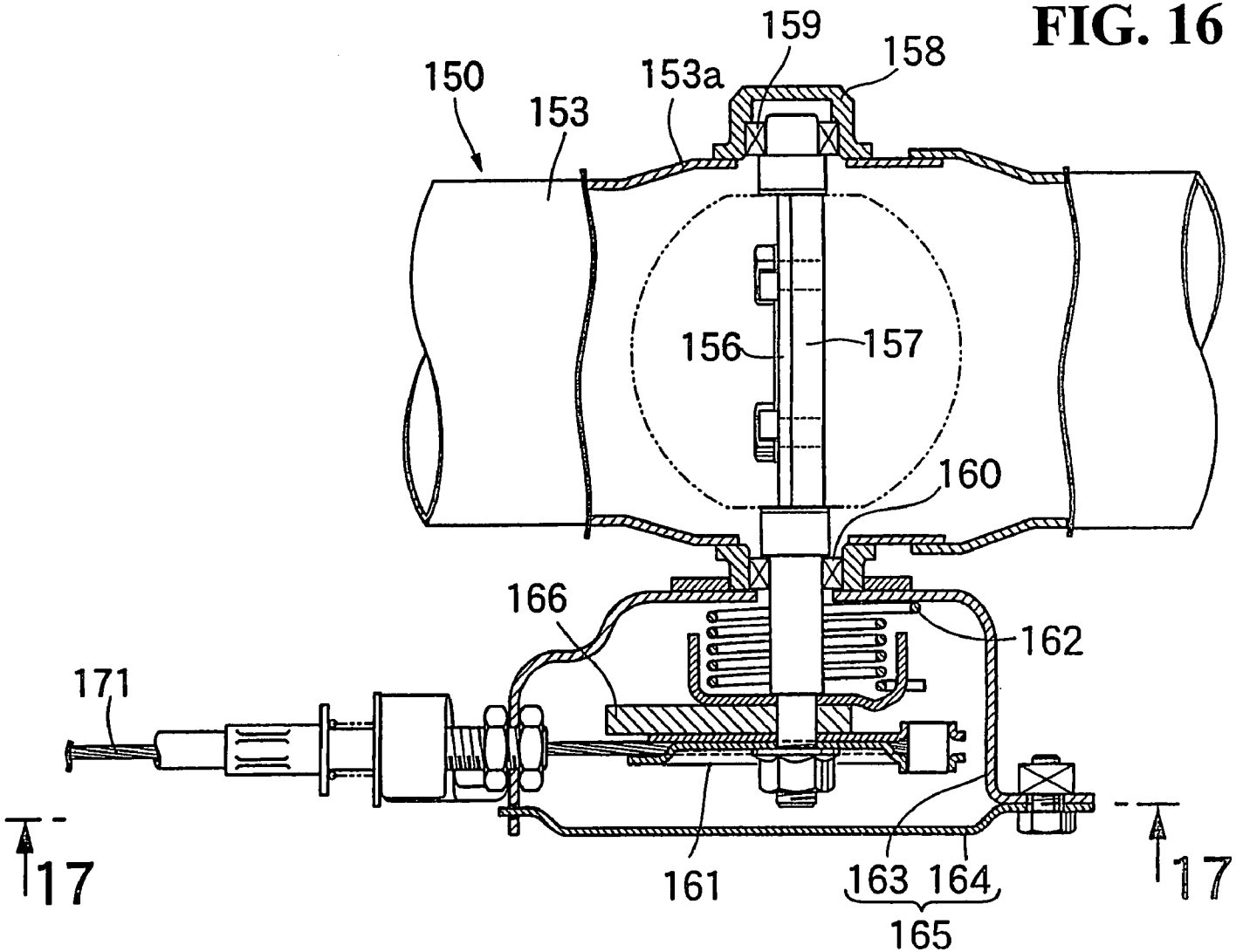
FIG. 16 is an enlarged cross-sectional view taken along line 16—16 of FIG. 2.
Figure 17:
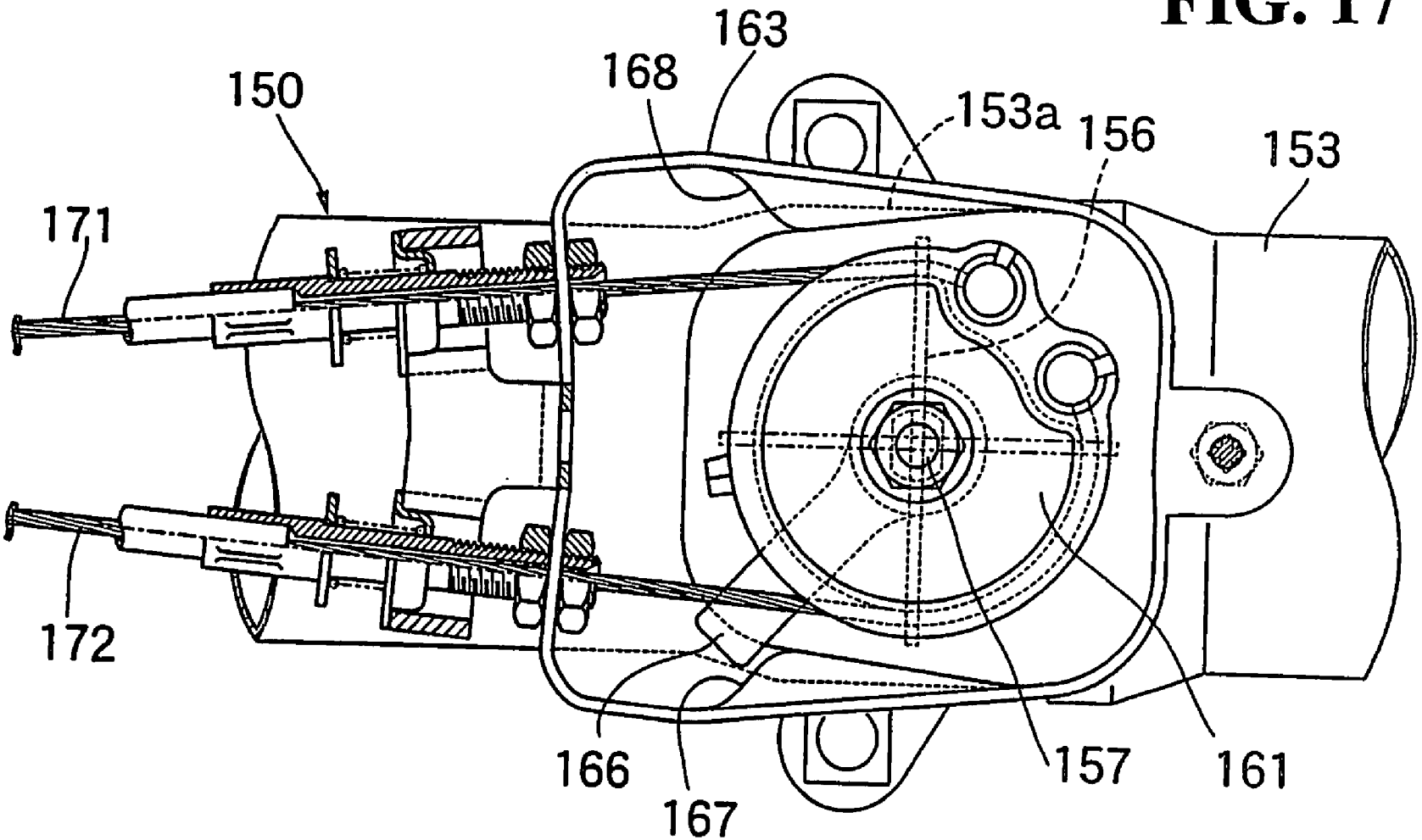
FIG. 17 is a cross-sectional view taken along line 17—17 of FIG. 16.

As also shown in FIGS. 16 and 17, the second joint exhaust pipe 153, which serves as part of the exhaust system 150, has a larger-diameter portion 153*a* positioned forwardly and upwardly of the axle 68 of the rear wheel WR. An exhaust control valve 156 is disposed in the larger-diameter portion 153*a* for changing the flow passage area in the second joint exhaust pipe 153 depending on the rotational speed of the engine E to control exhaust pulsations in the exhaust system 150.

When the engine E is in low and medium rotational speed ranges, the exhaust control valve 156 is operated into a closing side for increasing the output power of the engine E based on an exhaust pulsating effect in the exhaust system 150. When the engine E is in a high rotational speed range, the exhaust control valve 156 is operated into an opening side for increasing the output power of the engine E by reducing the resistance to the exhaust gas flow in the exhaust system 150. The exhaust control valve 156 is fixed to a valve shaft 157, which is turnably supported in the larger-diameter portion 153*a* of the second joint exhaust pipe 153.

The valve shaft 157 has an end supported by a seal 159 in a bottomed cylindrical bearing housing 158 that is fixed to the larger-diameter portion 153*a*. The other end of the valve shaft 157 projects from the larger-diameter portion 153*a* with a seal 160 interposed between the other end of the valve shaft 157 and the larger-diameter portion 153*a*. A driven pulley 161 is fixed to the projecting end of the valve shaft 157. A return spring 162 for urging the valve shaft 157 in a direction to open the exhaust control valve 156 acts between the valve shaft 157 and the larger-diameter portion 153*a*.

The end of the valve shaft 157 projecting from the larger-diameter portion 153*a*, the driven pulley 161, and the return spring 162 are housed in a case 165, which includes a cup-shaped main case body 163 fixed to the larger-diameter portion 153*a* and a lid plate 164 fastened to the main case body 163 in covering relation to an open end of the main case body 163.

A limit arm 166 having a distal end projecting from the outer circumferential edge of the driven pulley 161 is fixed to the valve shaft 157 with the case 165. On an inner surface of the main case body 163 of the case 165, there are disposed a closing stopper 167 for engaging the distal end of the limit arm 166 to limit the end of turning to the closing side of the valve shaft 157, i.e., the discharge control valve 156, and an opening stopper 168 for engaging the distal end of the limit arm 166 to limit the end of turning to the opening side of the valve shaft 157, i.e., the discharge control valve 156.

A second transmission wire 171 for operating the discharge control valve 156 into the closing side at the pulling time has an end trained around and engaged with the driven pulley 161. A third transmission wire 172 for operating the discharge control valve 156 into the opening side at the pulling time also has an end trained around and engaged with the driven pulley 161. As shown in FIG. 15, the other end of the second transmission wire 171 is trained around and engaged with the second wire groove 147 of the drive pulley 145 of the actuator 141 in a direction opposite to the direction in which the first transmission wire 135 is trained. The other end of the third transmission wire 172 is trained around and engaged with the third wire groove 148 of the drive pulley 144 in the same direction as the direction in which the first transmission wire 135 is trained.

Therefore, the actuator 141 for actuating the exhaust control valve 156 that is controlled depending on the rotational speed of the engine E is coupled to the first intake control valve 126 for turning the first intake control valve 126 in the intake duct 105.

Of the second joint discharge pipe 153, the larger-diameter portion 153*a* where the exhaust control valve 156 is disposed should desirably be disposed below the main seat 90 for avoiding, as much as possible, unwanted external forces applied from above to the second and third transmission wires 171, 172. The case 165 is disposed so as to be exposed outwardly as viewed in side elevation in order to facilitate impingement thereon of the running airflow.

The actuator 141 should desirably be disposed rearwardly and upwardly of the engine body 50 at such a position that the distance between the actuator 141 and the valve shaft 128 in the intake duct 105 and the distance between the actuator 141 and the valve shaft 157 of the exhaust valve 156 are substantially equal to each other. In this manner, any obstacles between the driven pulley 161 of the exhaust control valve 156 and the actuator 141 are minimized to allow the second and third transmission wires 171, 172, which interconnect the driven pulley 161 and the actuator 141, to be installed with ease.

Figure 18:
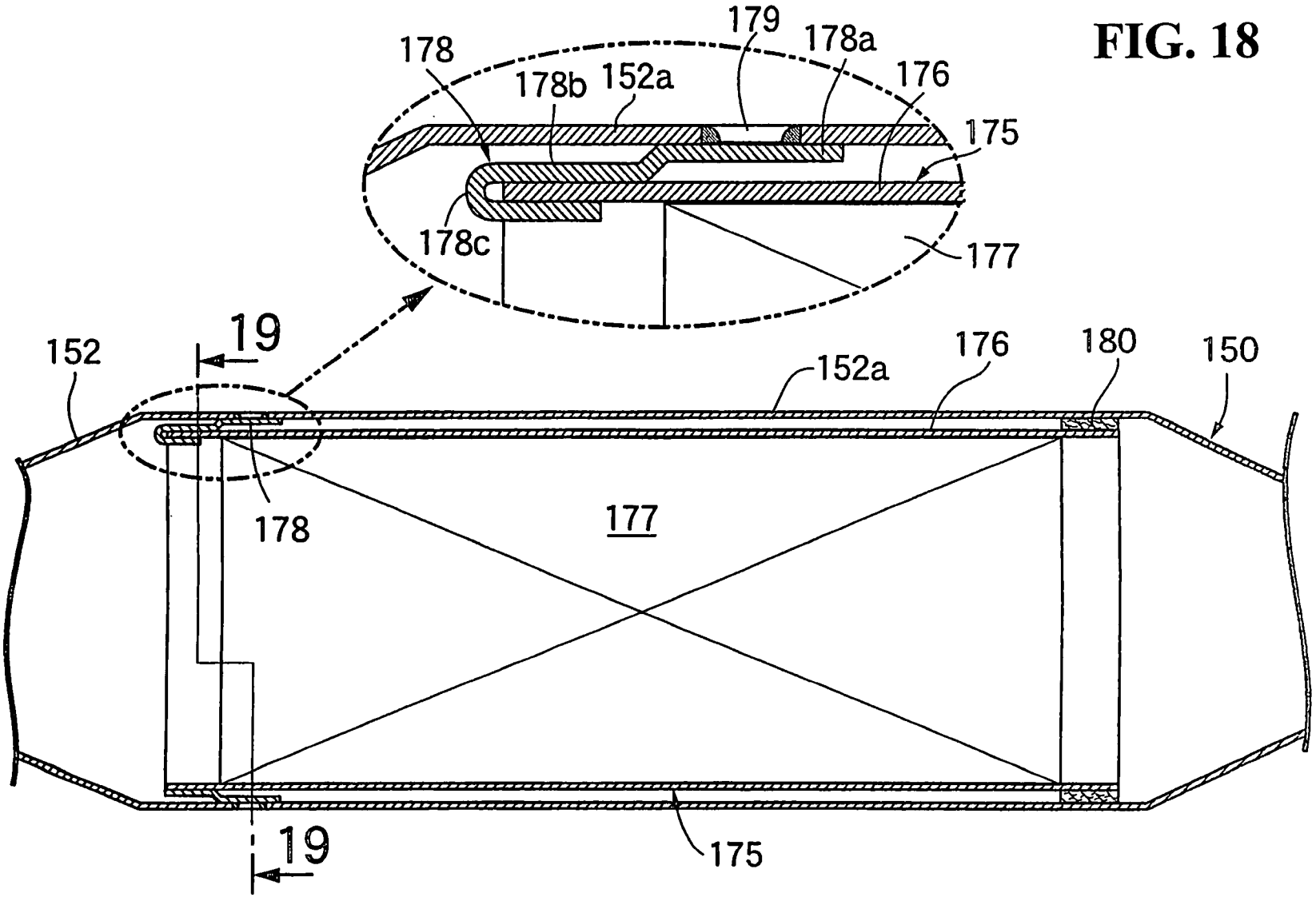
FIG. 18 is an enlarged cross-sectional view taken along line 18—18 of FIG. 2.
Figure 19:
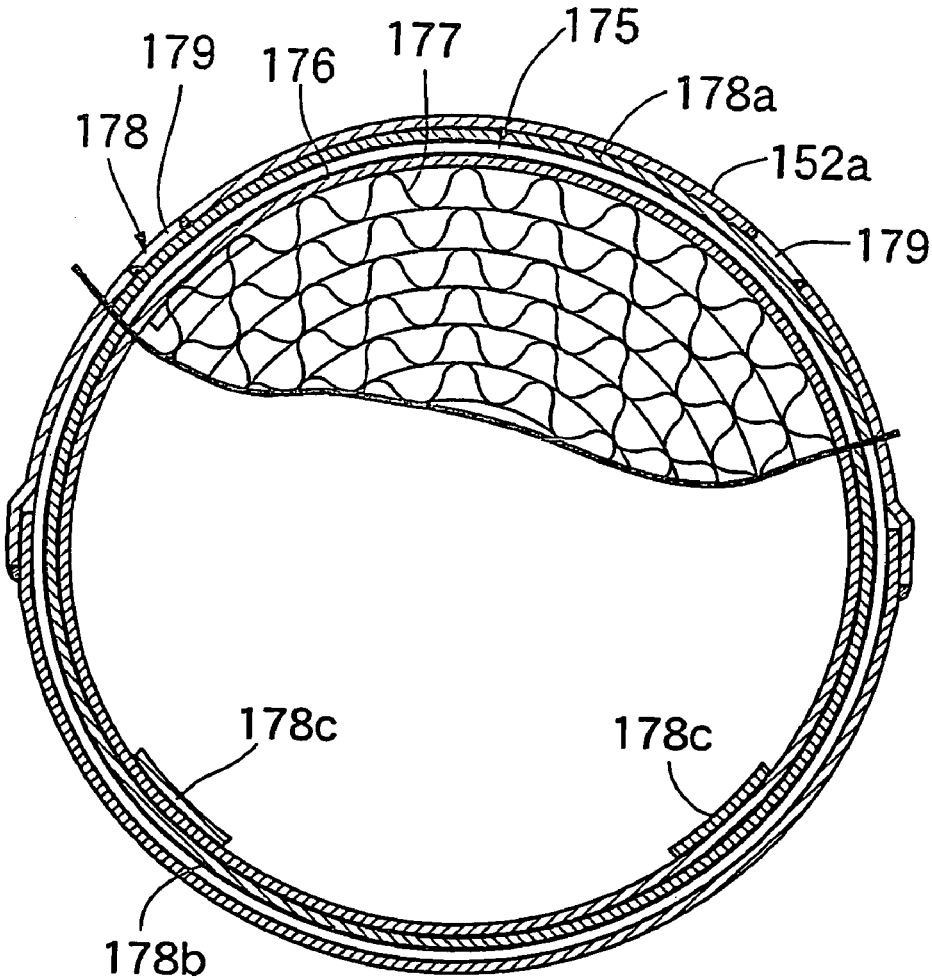
FIG. 19 is a cross-sectional view taken along line 19—19 of FIG. 18.

In FIGS. 18 and 19, the first joint exhaust pipes 152, which serve as part of the exhaust system 150, have respective larger-diameter portions 152*a* positioned below the engine body 50. A catalytic body 175 is housed in each of the larger-diameter portions 152*a*. With the catalytic body 175 disposed below the engine body 50, the exhaust gas discharged from the cylinder head 86 can pass through the catalytic body 175 while the exhaust gas is kept at a relatively high temperature.

The catalytic body 175 includes a cylindrical case 176 and a catalyst support 177, which is of a cylindrical shape for allowing the exhaust gas to pass therethrough. The catalyst support 177 is housed in the cylindrical case 176 and has an end disposed inwardly of an end of the case 176. The case 176 is made of a material different from the first joint exhaust pipe 152. For example, the first joint exhaust pipe 152 is made of titanium, and the case 176 and the catalyst support 177 of the catalytic body 175 are made of stainless steel.

A bracket 178 made of the same material, e.g., titanium, as the first joint exhaust pipe 152 is welded to an inner circumferential surface of the larger-diameter portions 152*a* of the first joint exhaust pipe 152. The bracket 178 includes a large ring 178*a* fitted in the larger-diameter portions 152*a* in surrounding relation to an end of the case 176, a small ring 178*b* contiguous to the large ring 178*a* with the end of the case 176 being fitted in the small ring 178*b*, and a plurality of, e.g., four, circumferentially equally spaced extension arms 178*c* extending from the small ring 178*b* in a direction opposite to the large ring 178*a*.

The larger-diameter portion 152*a* has a plurality of circumferentially spaced through holes 179 provided therein so as to face the outer circumferential surface of the large ring 178*a*. The large ring 178*a* is welded to the larger-diameter portions 152*a* at the through holes 179, thus securing the bracket 178 to the larger-diameter portions 152*a* of the first joint exhaust pipe 152. The extension arms 178*c* are crimped on the end of the case 176 of the catalytic body 175. The bracket 178 welded to the larger-diameter portions 152*a* of the first joint exhaust pipe 152 is crimped on the end of the case 176, which projects from the end of the catalyst support 177.

A ring 180 including a stainless mesh is spot-welded to the outer surface of the other end of the case 176 of the catalytic body 175. The ring 180 is interposed between the larger-diameter portions 152*a* of the first joint exhaust pipe 152 and the other end of the case 176, allowing the other end of the catalytic body 175 whose opposite end is fixed to the larger-diameter portions 152*a* by the bracket 178 to slide by way of thermal expansion. Therefore, stresses caused due to thermal expansion of the catalytic body 175 are prevented from being applied between the fixed end of the catalytic body 175 and the larger-diameter portions 152*a*.

Referring again to FIG. 1, the front area of the head pipe 22 is covered with a front cowl 181 made of synthetic resin. Front opposite side areas of the vehicle body are covered, with a central cowl 182 made of synthetic resin which is contiguous to the front cowl 181. A lower cowl 183 made of synthetic resin, which covers opposite sides of the engine body 50, is contiguous to the central cowl 182. Rear portions of the seat rails 30 are covered with a rear cowl 184.

An upper area of the front wheel WF is covered with a front fender 185 mounted on the front fork 21. A rear fender 186 covering an upper area of the rear wheel WR is mounted on the seat rails 30.

Operation of the present embodiment will be described below. The first cross pipe 27 is disposed between the front portions of the pair of left and right main frames 23 joined to the heat pipe 22 that is positioned at the front end of the vehicle frame F. The attachment holes 32 are coaxially provided in the inner side walls of the front portions of the main frames 23, and the first cross pipe 27 has its opposite ends inserted in the respective attachment holes 32 and welded to the inner side walls of the main frames 23. By changing the distance by which the opposite ends of the first cross pipe 27 are inserted into the attachment holes 32, dimensional errors between the pair of left and right main frames 23 and an error of the axial length of the first cross pipe 27 can be absorbed, allowing the opposite ends of the first cross pipe 27 to be reliably welded to the inner side walls of the main frames 23.

The head pipe 22 has the cylindrical portion 22*a* by which the front fork 21 is steerably supported and the pair of left and right gussets 22*b* extending rearwardly and downwardly from the cylindrical portion 22*a*. The main frames 23 include at least the gussets 22*b* and the pipes 31 welded respectively to the gussets 22*b*. The gussets 22*b* have the integral extensions 22*c* disposed inwardly of the front inner side walls of the pipes 31 and extending rearwardly, the extensions 22*c* serving as the front inner side walls of the main frames 23. The attachment holes 32 for inserting the opposite ends of the first cross pipe 27 therein in confronting relation to the front inner side walls of the pipes 31 are provided in the respective extensions 22*c*, and the opposite ends of the first cross pipe 27 are welded to the outer surfaces of the extensions 22*c*. Since the opposite ends of the first cross pipe 27 are welded to the outer surfaces of the extensions 22*c*, which are integral with the gussets 22*b* that serve as part of the main frames 23, the first cross pipe 27 can easily be welded to the main frame 23, and the appearance of the welded structure is fine as the welded regions are concealed from external view.

The pipes 31 are in the shape of the vertically elongate prismatic shape having the respective inner side walls 31*a*, which are flat substantially the full vertical length thereof, and the respective outer side walls 31*b* extending substantially along the inner side walls 31*a*. The pipes 31 can be bent with ease because they are bent in the plane PL perpendicular to the inner side walls 31*a*.

The pipes 31 are inclined progressively toward each other in the upward direction and are joined to the respective gussets 22*b* of the head pipe 22. Accordingly, with a simple structure of the inclined pipes 31, the space between the lower portions of the pipes 31 is widened to provide a sufficient installation space for the engine E, and the space between the upper portions of the pipes 31 is reduced to make the knees of the rider less liable to contact the pipes 31.

For supporting the engine body 50 on the upper and lower portions of the pivot plates 26 in the vehicle frame F, the insertion hole 53 for inserting the mount bolt 52 therethrough and the first engaging surface 54 surrounding the outer end of the insertion hole 53 for engaging the larger-diameter head 52*a* on one end of the bolt 52 are provided in one of the pivot plates 26, and the other pivot plate 26 has the threaded hole 57 coaxial with the insertion hole 53 and the second engaging surface 58 surrounding the outer end of the threaded hole 57. The tubular bolt 60 is threaded in the threaded hole 57 with the other end of the tubular bolt 60 being positioned inwardly of the second engaging surface 58 while the engine body 50 is being sandwiched between the end of the tubular bolt 60 and the inner side surface of the one of the pivot plates 26. The nut 63 capable of engaging the engaging surface 58 is threaded over the other end of the mount bolt 52, which is inserted in the insertion hole 53, the engine body 50, the tubular bolt 60, and the threaded hole 57 and projects from the threaded hole 57.

With the above structure by which the engine body 50 is supported on the vehicle frame F, it is possible, by adjusting the position where the tubular bolt 60 is threaded into the threaded hole 57, to sandwich the engine body 50 reliably between one of the pivot plates 26 and one end of the tubular body 60 while absorbing a dimensional error between the pivot plates 26 and a dimensional error in the transverse direction of the engine body 50. Since the larger-diameter head 52*a* at one end of the mount bolt 52 engages with the first engaging surface 54 of one of the pivot plates 26, and the nut 63, which is threaded over the other end of the mount bolt 52, engages with the second engaging surface 58 of the other pivot plate 26, the opposite ends of the mount bolt 52 can be fastened to the vehicle frame F so as to be firmly axially positioned, thus increasing the rigidity with which the engine body 50 is supported.

The tubular retaining bolt 61, which is held in abutment against the other end of the tubular bolt 60, is threaded in the threaded hole 57 so as to be positioned inwardly of the second engaging surface 58. Consequently, the retaining bolt 61 is held in contact with the other end of the tubular bolt 60 for effectively preventing the tubular bolt 60 from working loose.

The straight intake passages 92 for guiding purified air from the air cleaner 87 disposed above the cylinder head 86 are connected to the upper side wall of the cylinder head 86 of the engine body 50. The first injectors 100 for injecting fuel into the intake passages 92 from above are mounted on the cleaner case 96 of the air cleaner 87, and the fuel tank 88 is disposed in covering relation to rear and upper areas of the air cleaner 87. The first injectors 100 are disposed forwardly of the central lines C1 of the intake passages 92.

Specifically, the first injectors 100 are disposed at a position offset forwardly from the central lines Cl of the intake passages 92. On the central lines C1 of the intake passages 92, the bottom wall of the fuel tank 88 can be placed in a relatively low position while avoiding interference with the first injectors 100. Therefore, it is possible for the fuel tank 88 to have a sufficient capacity.

The first injectors 100 are disposed forwardly of the central line C2 of the fuel inlet port 101 that is provided in the front portion of the fuel tank 88. As the first injectors 100 do not interfere with the fuel tank 88 on the central line C2 of the fuel inlet port 101, the fuel inlet port 101 can be placed in a lower position. In addition, the first injectors 100 are mounted on the cleaner case 96 of the air cleaner 87 such that their upper portions are disposed forwardly of the points P of intersection between the central lines C1, C2 on the projection onto the plane parallel to the central line C2 of the fuel inlet port 101 and the central lines C1 of the intake passages 92. Therefore, the bottom wall of the fuel tank 88 can be placed in a relatively low position forwardly of the central line C2 of the fuel inlet port 101, making it possible for the fuel tank 88 and the air cleaner 87 to have a sufficient capacity, and also for a fuel supply nozzle to be inserted easily into the fuel inlet port 101 when the fuel is to be supplied to the fuel tank 88.

The second injectors 103 for ejecting the fuel into the intake passages 92 are disposed rearwardly and laterally of the throttle bodies 94 in the intake passages 92. The first injectors 100, which are supplied with the fuel at a relatively low temperature and eject the fuel from above the intake passages 92 to contribute to an increase in the output power of the engine E, and the second injectors 103, which are capable of injecting the fuel in reaction with good response to the operation of the engine E, can be placed using the installation space of the intake passages 92 effectively in a well balanced fashion.

The intake duct 105, which extends forwardly from the air cleaner 87 disposed on the head pipe 22 at the front end of the vehicle frame F, is disposed below the head pipe 22. In the intake duct 105, the first intake passage 119 whose transversely central portion is disposed on the transversely central line C3 of the front wheel WF and the pair of left and right second intake passages 120 disposed one on each side of the first intake passage 119 are provided with the flow passage area of the first intake passage 119 being greater than the total flow passage area of the second intake passages 120. The first intake control valve 126, which closes the first intake passage 119 when the engine E operates in a low rotational speed range and opens the first intake passage 119 when the engine E operates in a high rotational speed range, is disposed in the first intake passage 119.

With the above structure of the intake duct 105, when the engine E is in a low rotational speed range, i.e., when motorcycle is running at a low speed on a road from which water or foreign matter tends to be stirred up, since the first intake passage 119 whose transversely central portion is disposed on the transversely central line C3 of the front wheel WF is closed, such water or foreign matter is prevented as much as possible from entering the air cleaner 87. When the engine E is in a high rotational speed range, since water or foreign matter from the road is hardly stirred up due to the running airflow, such water or foreign matter is also prevented as much as possible from entering the air cleaner 87. Furthermore, as the first intake passage 119 having a large flow passage area is opened, it can introduce a relatively large amount of air into the air cleaner 87 to contribute to higher output power from the engine.

The first intake control valve 126 is fixed to the valve shaft 128 rotatably supported in the intake duct 105, and the second intake control valves 127 for changing the flow passage areas of the respective second intake passages 120 are fixed to the valve shaft 128 such that the second intake control valves 127 open the second intake passages 120 when the engine E operates in a low rotational speed range and close the second intake passages 120 when the engine E operates in a high rotational speed range.

By thus controlling the first intake control valve 126 and the second intake control valves 127, the amount of intake air when the engine E operates in a low rotational speed range is reduced for thereby preventing the air-fuel mixture from becoming leaner and supplying an appropriate dense air-fuel mixture to the engine E to achieve good acceleration performance when the motorcycle is accelerated. When the engine E operates in a high rotational speed range, the intake resistance is reduced to increase the volumetric efficiency of the engine E to contribute to an increase in high-speed output power performance of the engine. The structure is simple because the first intake control valve 126 and the second intake control valves 127 can be opened and closed by driving the turning of the valve shaft 128.

The baffle plates 122*a* are mounted on the intake duct 105 at respective positions spaced from the front end openings 120*a* of the second intake passages 120 so as to from gaps between the plates 122*a* and openings 120*a*. When external air is introduced from the second intake passages 120 into the air cleaner 87, a labyrinth structure provided by the baffle plates 122*a* prevents, as much as possible, water or foreign matter from entering the second intake passages 120.

The front end of the first intake passage 119 is open forwardly at the front end of the intake duct 105, and the front end openings 120*a* of the second intake passages 120 are formed at a front end portion of the duct 105 so as to open in a direction different from the opening direction of the front end of the first intake passage 119. Consequently, when the engine E operates in a high rotational speed range, the running airflow is efficiently introduced into the first intake passage 119 for an increased intake efficiency. When the engine E operates in a low rotational speed range, foreign matter or water is less liable to be introduced into the second intake passages 120, which introduce air.

The front end of the intake duct 105 is of the substantially triangular shape as viewed from its front side. The duct 105 has the upper edge extending along the lower edge of the junction between the head pipe 22 and the main frames 23 and the lower edge extending along the upper portion of the radiator 89 disposed below the intake duct 105. The intake duct 105 with a large opening at its front end can effectively be disposed in the space between the junction between the head pipe 22 and the main frames 23 and the radiator 89.

The actuator 141 mounted on the motorcycle for actuating the exhaust control valve 156, which is controlled depending on the rotational speed of the engine E, is coupled to the first and second intake control valves 126, 127 for opening and closing the first and second intake control valves 126, 127. Therefore, the first and second intake control valves 126, 127 can be actuated with the number of parts used being prevented from increasing and the intake device being made compact and lightweight.

The first intake control valve 126 is fixed to the valve shaft 128, which has an axis perpendicular to the air circulation direction circulated through the first intake passage 119 and is turnably supported in the intake duct 105, such that it is inclined upwardly in the rearward direction when it closes the first intake passage 119. Such a structure is advantageous in preventing water or foreign matter from entering the air cleaner 87. Specifically, water or foreign matter that has been stirred up by the front wheel WF is liable to enter an upper portion of the front end opening of the first intake passage 119. When the first intake control valve 126 starts moving from the closing side to the opening side, the water or foreign matter that has been stirred up and may have entered the front end opening of the first intake passage 119 tends to impinge upon the first intake control valve 126. Therefore, the foreign matter and water can be prevented from passing through the first intake control valve 126 into the air cleaner 87.

The first intake control valve 126, in the valve-closing state thereof, has the portion above the valve shaft 128 that has the area greater than the area of the portion of the first intake control valve 126 beneath the valve shaft 128. This structure is further advantageous in preventing water or foreign matter from entering the first intake passage 119.

The axle 68 of the rear wheel WR is rotatably supported on the rear end of the swing arm 66 whose front end is swingably supported on the vehicle frame F. The rear end outlet of the exhaust system 150, which is connected to the cylinder head 86 of the engine body 50 that is mounted on the vehicle frame F forwardly of the rear wheel WR, is disposed above the axle 68 of the rear wheel WR, and the exhaust control valve 156 for adjusting the flow passage area in the second joint exhaust pipe 153 is disposed in the second joint exhaust pipe 153, which serves as part of the exhaust system 150. The exhaust control valve 156 is disposed forwardly and upwardly of the axle 86 of the rear wheel WR.

The exhaust control valve 156 thus positioned is less liable to be affected by the rear wheel WR and is spaced from the grounding surface of the rear wheel WR. Consequently, the exhaust control valve 156 is placed in a good environment where its operation is less liable to be adversely affected by the rear wheel WR and the grounding surface of the rear wheel WR.

The catalytic body 175, which has the cylindrical case 176 made of a material different from the first joint exhaust pipe 152 and is housed in the first joint exhaust pipe 152, is fixed to the first joint exhaust pipe 152 serving as part of the exhaust system 150 by the bracket 178. The bracket 178, which is made of the same material as the first joint exhaust pipe 152, is welded to the inner circumferential surface of the larger-diameter portions 152*a* of the first joint exhaust pipe 152. The bracket 178 is crimped on the case 176 of the catalytic body 175.

Therefore, even if the case 176 of the catalytic body 175 and the first joint exhaust pipe 152 are made of different materials, the catalytic body 175 can be housed in and fixed to the first joint exhaust pipe 152, thus increasing the freedom in choosing materials for the case 176 of the catalytic body 175 and the first joint exhaust pipe 152.

The catalytic body 175 includes the cylindrical case 176 and the catalyst support 177, which is of the cylindrical shape for allowing the exhaust gas to pass therethrough. The catalyst support 177 is housed in the cylindrical case 176 and has the end disposed inwardly of the end of the case 176. The bracket 178 is crimped on the end of the case 176, which projects from the end of the catalyst support 177. Therefore, the catalytic body 175 is fixed to the first joint exhaust pipe 152 by a simple structure without affecting the catalyst support 177.

The catalytic body 175 does not have any movable portion and is disposed in the exhaust system 150 below the engine E. The exhaust control valve 156 has movable parts and is disposed in the exhaust system 150 rearwardly and upwardly of the engine E. The catalytic body 175 and the exhaust control valve 156 are thus spaced from each other in the exhaust system 150, so that the exhaust control valve 156 is prevented from being adversely affected by the heat from the catalytic body 175.

Figure 20:
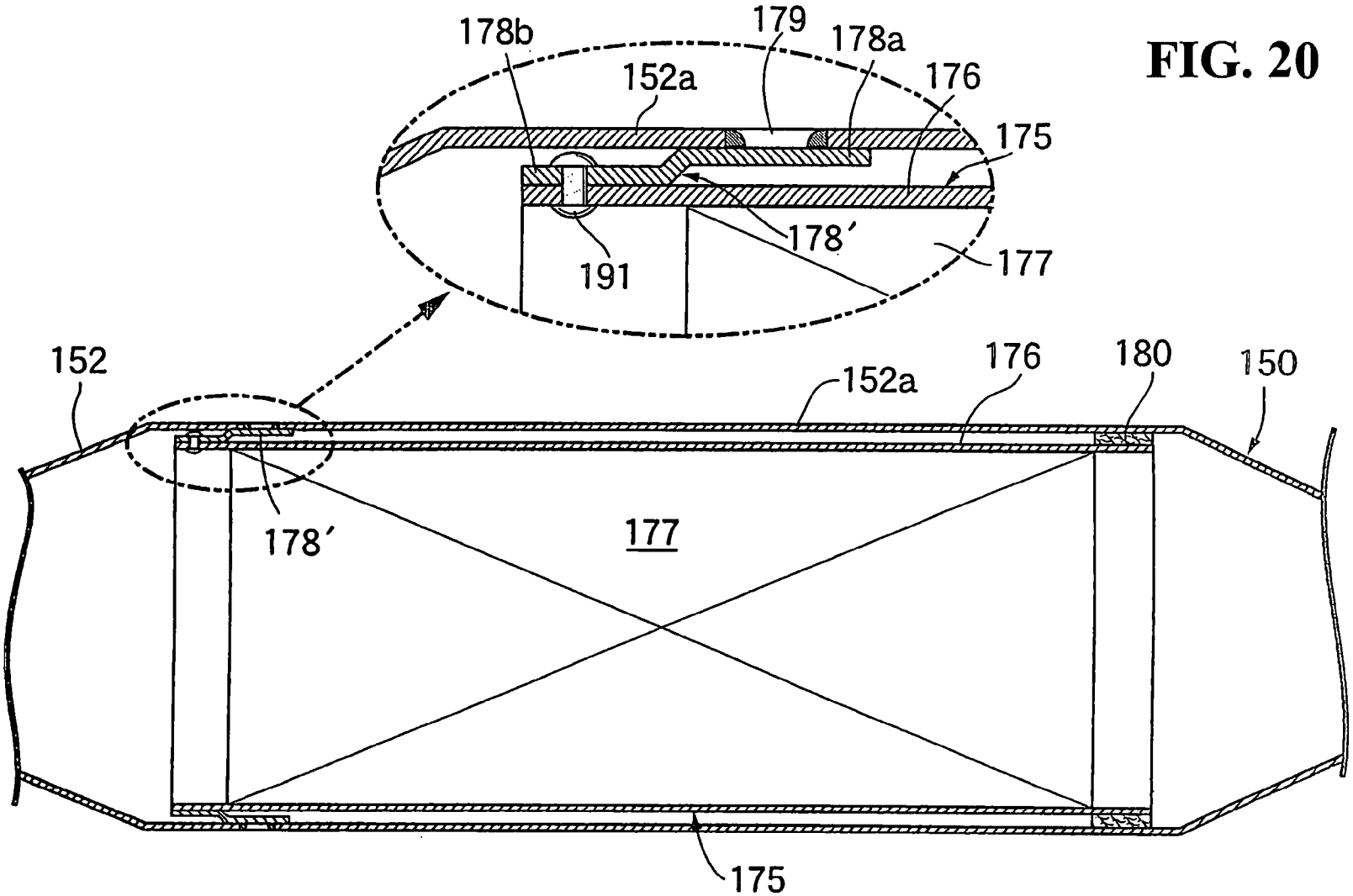
FIG. 20 is a cross-sectional view showing a second embodiment corresponding to FIG. 18.

FIG. 20 shows a second embodiment of the present invention. Those parts of the second embodiment corresponding to those of the first embodiment are denoted by identical reference characters.

A bracket 178' made of the same material, e.g., titanium, as the first joint exhaust pipe 152 is welded to an inner circumferential surface of the larger-diameter portions 152*a* of the first joint exhaust pipe 152 serving as part of the exhaust system 150.

The bracket 178' includes a large ring 178*a* fitted in the larger-diameter portion 152*a* in surrounding relation to an end of the case 176, and a small ring 178*b* contiguous to the large ring 178*a* with the end of the case 176 being fitted in the small ring 178*b*. The small ring 178*b* is connected at a plurality of circumferentially spaced locations to the end of the case 176 of the catalyst support 175 by rivets 191. Specifically, the bracket 178' welded to the larger-diameter portions 152*a* of the first joint exhaust pipe 152 is connected to the end of the case 176, which projects from the end of the catalyst support 177, by the rivets 191.

According to the second embodiment, even if the case 176 of the catalytic body 175 and the first joint exhaust pipe 152 are made of different materials, the catalytic body 175 can be housed in and fixed to the first joint exhaust pipe 152, thus increasing the freedom in choosing materials for the case 176 of the catalytic body 175 and the first joint exhaust pipe 152.

Furthermore, the catalytic body 175 includes the cylindrical case 176 and the catalyst support 177, which is of the cylindrical shape for allowing the exhaust gas to pass therethrough, the catalyst support 177 being housed in the cylindrical case 176 and having the end disposed inwardly of the end of the case 176. The bracket 178' is connected to the end of the case 176, which projects from the end of the catalyst support 177, by the rivets 191. Therefore, the catalytic body 175 is fixed to the first joint exhaust pipe 152 by a simple structure without affecting the catalyst support 177.

Figure 21:
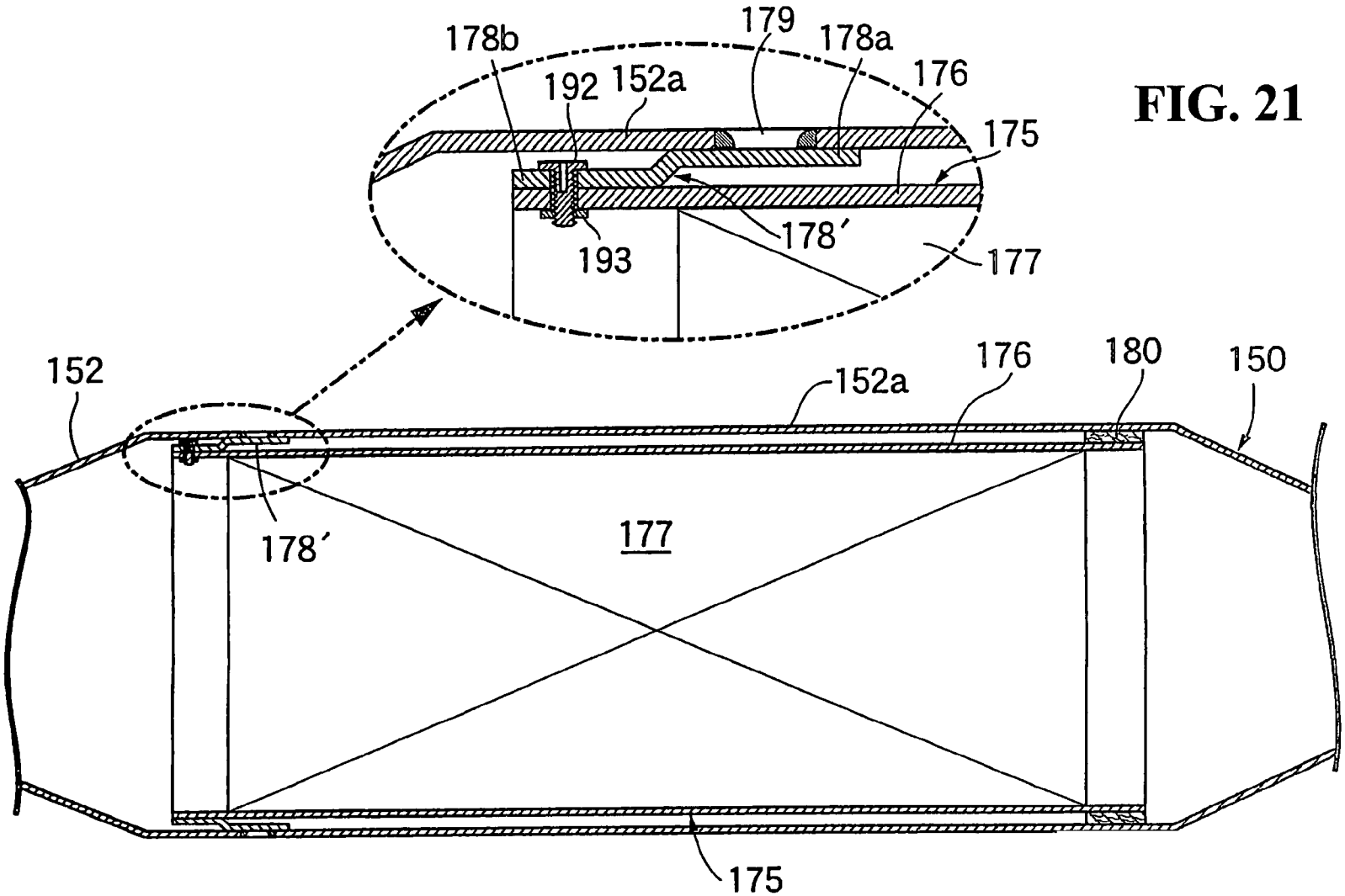
FIG. 21 is a cross-sectional view showing a third embodiment corresponding to FIG. 18.

FIG. 21 shows a third embodiment of the present invention. Those parts of the third embodiment corresponding to those of the first and second embodiments are denoted by identical reference characters.

A bracket 178' made of the same material, e.g., titanium, as the first joint exhaust pipe 152 is welded to an inner circumferential surface of the larger-diameter portions 152*a* of the first joint exhaust pipe 152 serving as part of the exhaust system 150. The small ring 178*b* of the bracket 178' is coupled at a plurality of circumferentially spaced locations to the end of the case 176 of the catalyst support 175 by thin bolts 192 and nuts 193, for example. Specifically, the bracket 178' welded to the larger-diameter portions 152*a* of the first joint exhaust pipe 152 is fastened to the end of the case 176, which projects from the end of the catalyst support 177.

According to the third embodiment, even if the case 176 of the catalytic body 175 and the first joint exhaust pipe 152 are made of different materials, the catalytic body 175 can be housed in and fixed to the first joint exhaust pipe 152, thus increasing the freedom in choosing materials for the case 176 of the catalytic body 175 and the first joint exhaust pipe 152.

Furthermore, the catalytic body 175 includes the cylindrical case 176 and the catalyst support 177, which is of the cylindrical shape for allowing the exhaust gas to pass therethrough, the catalyst support 177 being housed in the cylindrical case 176 and having the end disposed inwardly of the end of the case 176. The bracket 178' is fastened to the end of the case 176, which projects from the end of the catalyst support 177. Therefore, the catalytic body 175 is fixed to the first joint exhaust pipe 152 by a simple structure without affecting the catalyst support 177.

While the embodiments of the present invention have been described above, the present invention is not limited to the above embodiments, but various design changes may be made without departing from the present invention as it is described in the scope of claims for patent.

According to the first through third aspects of the present invention, even if the case of the catalytic body and the exhaust pipe are made of different materials, the catalytic body can be housed in and fixed to the exhaust pipe, thus increasing the freedom in choosing materials for the case of the catalytic body and the exhaust pipe.

According to the further aspects of the present invention, the catalytic body can be fixed to the exhaust pipe by a simple structure without affecting the catalyst support.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A catalytic body fixing structure for fixing a catalytic body to an exhaust pipe, the exhaust pipe for serving as part of an exhaust system of an engine, comprising:

a catalytic body having a generally cylindrical case made of a material different from the exhaust pipe and housed in the exhaust pipe; and a bracket made of the same material as the exhaust pipe, said bracket being welded to an inner circumferential surface of the exhaust pipe and crimped on the generally cylindrical case of said catalytic body, wherein said catalytic body has a generally cylindrical catalyst support for allowing an exhaust gas to flow theretbrough. the cylindrical catalyst support being housed in the cylindrical case and having an end disposed inwardly of an end of said cylindrical case, said bracket being crimped on the end of the cylindrical case in a region projecting from the end of the cylindrical catalyst support.

2. The catalytic body fixing structure according to claim 1, wherein the exhaust pipe is made of titanium, and the cylindrical case and the catalyst support of the catalytic body are made of stainless steel.

3. The catalytic body fixing structure according to claim 2, wherein the bracket is made of titanium.

4. The catalytic body fixing structure according to claim 1, wherein the bracket includes a large ring fitted in a larger-diameter portion of the exhaust pipe in surrounding relation to an end of the cylindrical case, a small ring contiguous to the large ring with the end of the case being fitted in the small ring, and a plurality of circumferentially equally spaced extension arms extending from the small ring in a direction opposite to the large ring, said plurality of extension arms being crimped on the cylindrical case.

5. The catalytic body fixing structure according to claim 4, wherein the larger-diameter portion of the exhaust pipe has a plurality of circumferentially spaced through holes provided therein so as to face an outer circumferential surface of the large ring, said large ring being welded to the larger diameter portion of the exhaust pipe at the through holes.

6. The catalytic body fixing structure according to claim 5, wherein a ring including a stainless mesh is spot-welded to the outer surface of the end of the cylindrical case opposite to the bracket, the ring being interposed between the larger-diameter portion of the exhaust pipe and the end of the cylindrical case opposite to the bracket, said ring allowing the end of the cylindrical case opposite to the bracket to slide by way of thermal expansion.

7. A catalytic body fixing structure for fixing a catalytic body to an exhaust pipe the exhaust pipe for serving as part of an exhaust system of an engine, comprising:

a catalytic body having a generally cylindrical case made of a material different from the exhaust pipe and housed in the exhaust pipe; and a bracket made of the same material as the exhaust pipe, said bracket being welded to an inner circumferential surface of the exhaust pipe and coupled to the generally cylindrical case of said catalytic body by a rivet, wherein the exhaust pipe is made of titanium, and the cylindrical case and the catalyst support of the catalytic body are made of stainless steel.

8. The catalytic body fixing structure according to claim 7, wherein said catalytic body has a generally cylindrical catalyst support for allowing an exhaust gas to flow therethrough, the cylindrical catalyst support being housed in the cylindrical case and having an end disposed inwardly of an end of said cylindrical case, said bracket being coupled by the rivet to the end of the cylindrical case in a region projecting from the end of the cylindrical catalyst support.

9. The catalytic body fixing structure according to claim 7, wherein the bracket is made of titanium.

10. The catalytic body fixing structure according to claim 7, wherein the bracket includes a large ring fitted in a larger-diameter portion of the exhaust pipe in surrounding relation to an end of the cylindrical case, a small ring contiguous to the large ring with the end of the case being fitted in the small ring, and a plurality of circumferentially equally spaced extension arms extending from the small ring in a direction opposite to the large ring, each of said plurality of extension arms being coupled by a rivet to the cylindrical case.

11. The catalytic body fixing structure according to claim 10, wherein the larger-diameter portion of the exhaust pipe has a plurality of circumferentially spaced through holes provided therein so as to face an outer circumferential surface of the large ring, said large ring being welded to the larger diameter portion of the exhaust pipe at the through holes.

12. The catalytic body fixing structure according to claim 11, wherein a ring including a stainless mesh is spot-welded to the outer surface of the end of the cylindrical case opposite to the bracket, the ring being interposed between the larger-diameter portion of the exhaust pipe and the end of the cylindrical case opposite to the bracket, said ring allowing the end of the cylindrical case opposite to the bracket to slide by way of thermal expansion.

13. A catalytic body fixing structure for fixing a catalytic body to an exhaust pipe the exhaust pipe for serving as part of an exhaust system of an engine, comprising:

a catalytic body having a generally cylindrical case made of a material different from the exhaust pipe and housed in the exhaust pipe; and a bracket made of the same material as the exhaust pipe, said bracket being welded to an inner circumferential surface of the exhaust pipe and being fastened to the generally cylindrical case of said catalytic body, wherein the bracket includes a large ring fitted in a larger-diameter portion of the exhaust pipe in surrounding relation to an end of the cylindrical case, a small ring contiguous to the large ring with the end of the case being fitted in the small ring, and a plurality of circumferentially equally spaced extension arms extending from the small ring in a direction opposite to the large ring, said plurality of extension arms being fastened to the cylindrical case.

14. The catalytic body fixing structure according to claim 13, wherein said catalytic body has a generally cylindrical catalyst support for allowing an exhaust gas to flow therethrough, the cylindrical catalyst support being housed in the cylindrical case and having an end disposed inwardly of an end of said cylindrical case, said bracket being fastened to the end of the cylindrical case in a region projecting from the end of the generally cylindrical catalyst support.

15. The catalytic body fixing structure according to claim 13, wherein the exhaust pipe is made of titanium, and the cylindrical case and the catalyst support of the catalytic body are made of stainless steel.

16. The catalytic body fixing structure according to claim 15, wherein the bracket is made of titanium.

17. The catalytic body fixing structure according to claim 13, wherein the larger-diameter portion of the exhaust pipe has a plurality of circumferentially spaced through holes provided therein so as to face an outer circumferential surface of the large ring, said large ring being welded to the larger diameter portion of the exhaust pipe at the through holes.

18. The catalytic body fixing structure according to claim 17, wherein a ring including a stainless mesh is spot-welded to the outer surface of the end of the cylindrical case opposite to the bracket, the ring being interposed between the larger-diameter portion of the exhaust pipe and the end of the cylindrical case opposite to the bracket, said ring allowing the end of the cylindrical case opposite to the bracket to slide by way of thermal expansion.

* * * * *